US010265565B2

(12) United States Patent
Jue et al.

(10) Patent No.: US 10,265,565 B2
(45) Date of Patent: Apr. 23, 2019

(54) SUPPORT FRAME AND RELATED UNWEIGHTING SYSTEM

(71) Applicant: ALTERG, INC., Fremont, CA (US)

(72) Inventors: Clifford T. Jue, Santa Cruz, CA (US); Gregory P. Marecek, Palo Alto, CA (US)

(73) Assignee: AlterG, Inc., Fremont, CA (US)

( * ) Notice: Subject to any disclaimer, the term of this patent is extended or adjusted under 35 U.S.C. 154(b) by 245 days.

(21) Appl. No.: 14/769,114

(22) PCT Filed: Mar. 14, 2014

(86) PCT No.: PCT/US2014/029002

§ 371 (c)(1),
(2) Date: Aug. 20, 2015

(87) PCT Pub. No.: WO2014/153088

PCT Pub. Date: Sep. 25, 2014

(65) Prior Publication Data

US 2016/0008650 A1 Jan. 14, 2016

Related U.S. Application Data

(60) Provisional application No. 61/784,387, filed on Mar. 14, 2013.

(51) Int. Cl.
*A61H 1/02* (2006.01)
*A61H 3/00* (2006.01)
(Continued)

(52) U.S. Cl.
CPC .. *A63B 21/00181* (2013.01); *A63B 21/00069* (2013.01); *A63B 21/4009* (2015.10);
(Continued)

(58) Field of Classification Search
CPC ..... A63B 21/00181; A63B 21/00069; A63B 22/02–22/0264; A63B 22/0285;
(Continued)

(56) References Cited

U.S. PATENT DOCUMENTS 32,109 A 4/1861 DeBrame
43,972 A 8/1864 Coldwell
(Continued)

FOREIGN PATENT DOCUMENTS

CA 2216216 A 5/1999
DE 02623091 A1 11/1977
(Continued)

OTHER PUBLICATIONS

Burgess et al.; Overground walking speed changes when subjected to body weight support conditions for nonimpaired and post stroke individuals; J NeuroEng Rehabil.; 7(6); 10 pgs.; Feb. 2010.
(Continued)

*Primary Examiner* — Gary D Urbiel Goldner
(74) *Attorney, Agent, or Firm* — Shay Glenn LLP

(57) ABSTRACT

An unweighting system includes a frame, a pair of front pulleys, a pair of rear pulleys, a first cable, and a second cable. The frame is configured to be attached to or placed at least partially around an exercise device and includes a front portion and a rear portion. The pair of front pulleys is coupled to the front portion. The pair of rear pulleys is coupled to the rear portion. A first cable passes through a first of the pair of front pulleys and through a first of the pair of rear pulleys. A second cable passes through a second of the pair of front pulleys and through a second of the pair of rear pulleys. The first and second cables are configured to couple with a user to unload a portion of the user's weight as the user exercises on the exercise device.

12 Claims, 26 Drawing Sheets

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 22/00*** | (2006.01) |
| ***A63B 22/02*** | (2006.01) |
| ***A63B 22/06*** | (2006.01) |
| ***A63B 23/04*** | (2006.01) |
| ***A63B 24/00*** | (2006.01) |
| ***A63B 69/00*** | (2006.01) |
| ***A63B 71/00*** | (2006.01) |
| ***A63B 21/005*** | (2006.01) |
| ***A63B 21/008*** | (2006.01) |
| ***A63B 21/055*** | (2006.01) |
| ***A63B 21/062*** | (2006.01) |
| ***A63B 21/068*** | (2006.01) |

(52) U.S. Cl.

CPC ..... *A63B 22/02* (2013.01); *A63B 23/04* (2013.01); *A63B 24/0087* (2013.01); *A63B 69/0064* (2013.01); *A61H 1/0237* (2013.01); *A61H 3/00* (2013.01); *A61H 2201/165* (2013.01); *A61H 2201/5061* (2013.01); *A63B 21/008* (2013.01); *A63B 21/0058* (2013.01); *A63B 21/0085* (2013.01); *A63B 21/023* (2013.01); *A63B 21/0428* (2013.01); *A63B 21/055* (2013.01); *A63B 21/0552* (2013.01); *A63B 21/068* (2013.01); *A63B 21/0628* (2015.10); *A63B 22/0056* (2013.01); *A63B 22/0605* (2013.01); *A63B 22/0664* (2013.01); *A63B 2024/0093* (2013.01); *A63B 2071/0063* (2013.01); *A63B 2220/51* (2013.01); *A63B 2220/805* (2013.01)

(58) Field of Classification Search

CPC . A63B 22/0292; A63B 21/154; A63B 21/156; A63B 69/0064; A63B 71/0054; A63B 2071/0063; A63B 21/4009; A63B 21/0058; A63B 21/0085; A63B 21/023; A63B 21/055; A63B 21/0552; A63B 21/068; A63B 21/0428; A63B 21/0628; A63B 21/008; A61H 3/00; A61H 3/008; A61H 2003/007; A61H 2201/1652; A61H 1/0218

See application file for complete search history.

(56) References Cited

U.S. PATENT DOCUMENTS

| | | | | | |
|---|---|---|---|---|---|
| 63,637 | A | | 9/1867 | Mason | |
| 76,053 | A | | 3/1868 | Colwell | |
| 217,918 | A | | 7/1879 | White | |
| 219,439 | A | | 9/1879 | Blend | |
| 458,136 | A | | 8/1891 | Wilder | |
| 823,812 | A | | 6/1906 | Ritter | |
| 1,193,374 | A | | 8/1916 | Gilliam | |
| 1,223,707 | A | | 4/1917 | Lyon | |
| 1,507,554 | A | | 9/1924 | Cooper | |
| 1,553,520 | A | | 9/1925 | Dougherty | |
| 1,578,852 | A | | 3/1926 | Schmutzer | |
| 1,580,508 | A | | 4/1926 | Liles | |
| 1,586,254 | A | | 5/1926 | Lovejoy | |
| 2,050,500 | A | | 8/1936 | Osborn | |
| 2,108,566 | A | | 2/1938 | Brooke | |
| 2,109,188 | A | | 2/1938 | Elizaveta | |
| 2,327,671 | A | | 8/1943 | Rupprecht | |
| 2,438,979 | A | | 4/1948 | Lea | |
| 2,719,568 | A | | 10/1955 | Webb | |
| 2,785,004 | A | | 3/1957 | Cooper | |
| 2,819,755 | A | | 1/1958 | Harold et al. | |
| 2,871,915 | A | | 2/1959 | Hogan | |
| 2,892,455 | A | | 6/1959 | Hutton | |
| 2,991,523 | A | | 7/1961 | Del Conte | |
| 3,085,357 | A | | 4/1963 | Nissen et al. | |
| 3,140,869 | A | | 7/1964 | Pacuk | |
| 3,165,314 | A | | 1/1965 | Clearman et al. | |
| 3,176,793 | A | | 4/1965 | Roland | |
| 3,252,704 | A | | 5/1966 | Louise | |
| 3,730,587 | A | | 5/1973 | Bloxham et al. | |
| 3,738,027 | A | | 6/1973 | Schoch | |
| 3,747,596 | A | | 7/1973 | Mills | |
| 3,778,052 | A | | 12/1973 | Andow et al. | |
| 3,824,994 | A | | 7/1974 | Soderberg, Sr. | |
| 4,188,966 | A | | 2/1980 | Palmer et al. | |
| 4,205,839 | A | | 6/1980 | Best | |
| 4,211,426 | A | | 7/1980 | Motloch | |
| 4,479,646 | A | | 10/1984 | Beistegui Chirapozu | |
| 4,551,108 | A | | 11/1985 | Bass | |
| 4,655,447 | A | | 4/1987 | Dubrinsky et al. | |
| 4,731,882 | A | | 3/1988 | Ekman | |
| 4,805,601 | A | | 2/1989 | Eischen, Sr. | |
| 4,861,021 | A | | 8/1989 | Edwards et al. | |
| 4,863,163 | A | | 9/1989 | Wehrell | |
| 4,911,426 | A | | 3/1990 | Scales | |
| 4,921,245 | A | | 5/1990 | Roberts | |
| 4,922,426 | A | | 5/1990 | Obara et al. | |
| 4,941,497 | A | | 7/1990 | Prather et al. | |
| 4,961,544 | A | | 10/1990 | Bidoia | |
| 4,961,573 | A | | 10/1990 | Wehrell | |
| 4,968,028 | A | | 11/1990 | Wehrell | |
| 4,976,623 | A | | 12/1990 | Owsley | |
| 5,000,440 | A | | 3/1991 | Lynch | |
| 5,029,579 | A | | 7/1991 | Trammel | |
| 5,048,836 | A | | 9/1991 | Bellagamba | |
| 5,064,193 | A | * | 11/1991 | Sainte | A63B 21/0083 482/113 |
| 5,070,816 | A | | 12/1991 | Wehrell | |
| 5,156,549 | A | | 10/1992 | Wehrell | |
| 5,174,590 | A | | 12/1992 | Kerley et al. | |
| 5,176,597 | A | | 1/1993 | Bryne | |
| 5,221,241 | A | | 6/1993 | Bare | |
| 5,273,502 | A | * | 12/1993 | Kelsey | A61H 1/0229 482/66 |
| 5,275,426 | A | | 1/1994 | Tankersley | |
| 5,288,283 | A | | 2/1994 | Meeker | |
| 5,348,035 | A | | 9/1994 | Porter | |
| 5,360,384 | A | | 11/1994 | Toensing | |
| 5,362,298 | A | * | 11/1994 | Brown | A63B 21/154 482/113 |
| 5,368,533 | A | | 11/1994 | Feuer et al. | |
| 5,372,561 | A | | 12/1994 | Lynch | |
| 5,391,115 | A | | 2/1995 | Bessey | |
| 5,398,678 | A | | 3/1995 | Gamow | |
| 5,403,253 | A | | 4/1995 | Gaylord | |
| 5,403,270 | A | | 4/1995 | Schipper | |
| 5,435,798 | A | | 7/1995 | Habing et al. | |
| 5,512,029 | A | | 4/1996 | Barnard et al. | |
| 5,526,893 | A | | 6/1996 | Higer | |
| 5,569,129 | A | | 10/1996 | Self Naraghi et al. | |
| 5,577,984 | A | | 11/1996 | Bare, II | |
| 5,593,368 | A | | 1/1997 | Checketts | |
| 5,601,527 | A | | 2/1997 | Selkowitz | |
| 5,603,677 | A | * | 2/1997 | Sollo | A61H 1/0229 135/67 |
| 5,626,540 | A | | 5/1997 | Hall | |
| 5,662,560 | A | | 9/1997 | Svendsen et al. | |
| 5,667,461 | A | * | 9/1997 | Hall | A61H 1/0229 472/15 |
| 5,671,822 | A | | 9/1997 | Phillips | |
| 5,695,432 | A | * | 12/1997 | Soderlund | A63B 69/0064 482/69 |
| 5,704,880 | A | | 1/1998 | Amatulle | |
| 5,704,881 | A | | 1/1998 | Dudley | |
| 5,706,822 | A | | 1/1998 | Khavari | |
| 5,738,616 | A | | 4/1998 | Robertson | |
| 5,788,606 | A | | 8/1998 | Rich | |
| 5,816,983 | A | | 10/1998 | Dawes et al. | |
| 5,857,944 | A | | 1/1999 | Cone et al. | |
| 5,876,311 | A | | 3/1999 | Coates et al. | |

(56) References Cited

U.S. PATENT DOCUMENTS 5,893,367 A 4/1999 Dubats et al.
5,919,119 A 7/1999 Bohmer et al.
5,919,419 A 7/1999 Majuri
5,921,892 A 7/1999 Easton
5,960,480 A 10/1999 Neustater et al.
6,093,024 A 7/2000 Sokolowski
6,120,418 A 9/2000 Plough
6,128,782 A 10/2000 Young et al.
6,146,315 A * 11/2000 Schonenberger ..... A63B 22/02 482/54
6,158,389 A 12/2000 Wehrell
6,217,493 B1 * 4/2001 Spletzer ..... A63B 21/0605 482/103
6,223,854 B1 5/2001 Nolz
6,244,379 B1 6/2001 Larson
6,261,205 B1 7/2001 Elefson
6,270,414 B2 8/2001 Roelofs
6,273,844 B1 8/2001 Kelsey et al.
6,280,361 B1 8/2001 Harvey et al.
6,405,685 B1 6/2002 Cox
6,436,009 B1 8/2002 Marucci
6,438,756 B1 8/2002 Colorado
6,482,128 B1 11/2002 Michalow
6,490,733 B1 12/2002 Casaubon
6,494,811 B1 12/2002 Alessandri
6,527,285 B1 3/2003 Calandro, II
6,554,747 B1 * 4/2003 Rempe ..... A63B 21/04 482/38
6,578,594 B1 6/2003 Bowen et al.
6,612,845 B1 9/2003 Macri et al.
6,645,126 B1 11/2003 Martin et al.
6,648,411 B2 11/2003 Julien
6,656,091 B1 12/2003 Abelbeck et al.
6,666,801 B1 12/2003 Michalow
6,669,605 B2 12/2003 Scates
6,679,510 B2 1/2004 Perena
6,689,075 B2 2/2004 West
6,742,523 B2 * 6/2004 Dubats ..... A61H 3/008 128/875
6,783,482 B2 8/2004 Oglesby et al.
6,821,233 B1 * 11/2004 Colombo ..... A61F 5/0102 482/54
6,892,403 B2 5/2005 Liljedahl
6,918,858 B2 7/2005 Watterson et al.
6,932,709 B1 8/2005 Gubitosi et al.
6,935,353 B2 8/2005 Hawkes et al.
6,966,870 B2 11/2005 Lan
6,978,497 B1 12/2005 Takizawa
6,988,951 B1 1/2006 Newman et al.
7,166,064 B2 1/2007 Watterson et al.
7,240,621 B2 7/2007 Chepurny et al.
7,278,958 B2 10/2007 Morgan
7,294,094 B1 11/2007 Howle
7,341,543 B2 3/2008 Dandy
7,381,163 B2 6/2008 Gordon et al.
7,472,964 B2 1/2009 King
7,494,453 B2 2/2009 Wehrell
7,544,172 B2 6/2009 Santos-Munne et al.
7,572,190 B2 8/2009 Habing
7,572,209 B2 8/2009 Brennan
7,591,795 B2 9/2009 Whalen et al.
7,594,281 B1 9/2009 Stinson et al.
7,608,025 B1 10/2009 Best
7,614,991 B2 11/2009 Fox
7,625,320 B2 12/2009 Wehrell
7,651,450 B2 1/2010 Wehrell
7,666,126 B2 2/2010 Rempe
7,727,076 B2 6/2010 Bapst et al.
7,780,587 B2 8/2010 Thornton et al.
7,785,242 B2 8/2010 Solomon
7,837,597 B2 11/2010 Reyes et al.
7,850,629 B2 12/2010 Ravikumar
7,857,731 B2 12/2010 Hickman et al.
7,862,478 B2 1/2011 Watterson et al.
7,874,223 B2 1/2011 Sugar et al.
7,883,450 B2 2/2011 Hidler
7,887,471 B2 2/2011 McSorley
7,914,420 B2 3/2011 Daly et al.
7,938,756 B2 5/2011 Rodetsky et al.
7,955,219 B2 6/2011 Birrell et al.
7,998,040 B2 8/2011 Kram et al.
8,083,643 B2 12/2011 Ng et al.
8,109,478 B2 2/2012 Tristao
8,152,699 B1 4/2012 Ma et al.
8,172,724 B2 5/2012 Solomon
8,221,293 B2 7/2012 Hoffman et al.
8,235,724 B2 8/2012 Gilley et al.
8,246,354 B2 8/2012 Chu et al.
8,251,863 B2 8/2012 Faulring et al.
8,425,620 B2 4/2013 Johnson et al.
8,447,401 B2 5/2013 Miesel et al.
8,464,716 B2 6/2013 Kuehne et al.
8,470,051 B2 6/2013 Moyer et al.
8,480,602 B1 * 7/2013 Cook ..... A63B 69/0064 482/54
8,656,516 B1 2/2014 Reinhardt Rawlings et al.
8,762,167 B2 6/2014 Blander et al.
8,840,572 B2 9/2014 Whalen et al.
8,888,664 B1 * 11/2014 Butler ..... A63B 21/154 482/100
8,968,163 B1 * 3/2015 Vidmar ..... A61H 3/008 482/43
9,087,454 B2 7/2015 Crivello et al.
9,314,393 B2 * 4/2016 Kim ..... A61H 1/0255
9,370,680 B1 * 6/2016 Macaulay ..... A63B 21/0552
9,474,934 B1 10/2016 Krueger et al.
9,483,957 B1 11/2016 Fuemmeler
9,672,754 B2 6/2017 Yuen et al.
9,713,439 B1 * 7/2017 Wu ..... A61B 5/11
2002/0010056 A1 1/2002 Borsheim
2002/0022554 A1 * 2/2002 Borsheim ..... A63B 22/02 482/54
2002/0032103 A1 3/2002 Cook
2002/0065173 A1 5/2002 Cook
2004/0016043 A1 1/2004 Uno et al.
2004/0212240 A1 10/2004 Zwezdaryk
2004/0245298 A1 12/2004 Refsum
2004/0249675 A1 12/2004 Stark et al.
2005/0026757 A1 2/2005 Creary
2005/0101448 A1 5/2005 He et al.
2005/0183759 A1 8/2005 Wolfe
2005/0250624 A1 11/2005 Yu
2006/0031984 A1 2/2006 Takizawa
2006/0052728 A1 3/2006 Kerrigan et al.
2006/0062413 A1 3/2006 Wehrell
2006/0079378 A1 4/2006 Ader
2006/0240956 A1 * 10/2006 Piane, Jr. ..... A63B 21/055 482/94
2007/0016116 A1 1/2007 Reinkensmeyer et al.
2007/0219059 A1 9/2007 Schwartz et al.
2007/0219069 A1 9/2007 Nativ
2007/0272484 A1 11/2007 Helms
2008/0017227 A1 1/2008 Ward
2008/0070757 A1 3/2008 Albert
2008/0229495 A1 9/2008 Takizawa
2008/0281633 A1 11/2008 Burdea et al.
2008/0282442 A1 11/2008 Bauvois
2008/0300118 A1 12/2008 Wehrell
2008/0306412 A1 12/2008 Nieminen et al.
2009/0014004 A1 1/2009 Whalen et al.
2009/0047644 A1 2/2009 Mensah et al.
2009/0082700 A1 3/2009 Whalen et al.
2009/0221404 A1 9/2009 Dorogusker et al.
2009/0236176 A1 9/2009 Sheu et al.
2009/0255531 A1 10/2009 Johnson et al.
2009/0269728 A1 10/2009 Verstegen et al.
2009/0312165 A1 * 12/2009 Rempe ..... A63B 22/18 482/146
2010/0000547 A1 1/2010 Johnson et al.
2010/0006737 A1 1/2010 Colombo et al.
2010/0139057 A1 6/2010 Soderberg et al.
2010/0170546 A1 7/2010 Popovic et al.

(56) References Cited

U.S. PATENT DOCUMENTS

| | | | | |
|---|---|---|---|---|
| 2010/0197462 | A1* | 8/2010 | Piane, Jr. | A61B 5/1113 482/5 |
| 2010/0197465 | A1 | 8/2010 | Stevenson | |
| 2010/0248903 | A1 | 9/2010 | Cardile | |
| 2010/0279837 | A1 | 11/2010 | Stengel | |
| 2011/0086743 | A1 | 4/2011 | Stewart | |
| 2011/0098157 | A1 | 4/2011 | Whalen et al. | |
| 2011/0098615 | A1 | 4/2011 | Whalen et al. | |
| 2011/0179068 | A1 | 7/2011 | O'Brien | |
| 2011/0219899 | A1 | 9/2011 | Dize et al. | |
| 2012/0004581 | A1 | 1/2012 | Dinon | |
| 2012/0029666 | A1 | 2/2012 | Crowley et al. | |
| 2012/0042917 | A1 | 2/2012 | Workman et al. | |
| 2012/0238921 | A1 | 9/2012 | Kuehne et al. | |
| 2012/0277643 | A1 | 11/2012 | Whalen et al. | |
| 2012/0302301 | A1 | 11/2012 | Homsi | |
| 2013/0095459 | A1 | 4/2013 | Tran | |
| 2013/0324893 | A1 | 12/2013 | Kuehne et al. | |
| 2013/0325491 | A1 | 12/2013 | Ferrari | |
| 2014/0026893 | A1 | 1/2014 | Johnson et al. | |
| 2014/0081661 | A1 | 3/2014 | Fu et al. | |
| 2014/0113775 | A1 | 4/2014 | Egan | |
| 2014/0147820 | A1 | 5/2014 | Snow et al. | |
| 2014/0228985 | A1 | 8/2014 | Elliott et al. | |
| 2015/0011917 | A1 | 1/2015 | Whalen et al. | |
| 2015/0199494 | A1 | 7/2015 | Koduri et al. | |
| 2015/0251055 | A1 | 9/2015 | Ashby | |
| 2015/0379239 | A1 | 12/2015 | Basta et al. | |
| 2016/0000155 | A1 | 1/2016 | Marecek et al. | |
| 2016/0001118 | A1 | 1/2016 | Kuehne et al. | |
| 2016/0001119 | A1 | 1/2016 | Jue et al. | |
| 2016/0007885 | A1 | 1/2016 | Basta et al. | |
| 2016/0073704 | A1 | 3/2016 | Basta et al. | |
| 2017/0027803 | A1* | 2/2017 | Agrawal | A61B 5/6828 |

FOREIGN PATENT DOCUMENTS

| | | | |
|---|---|---|---|
| DE | 29508818 | U1 | 11/1995 |
| DE | 19502801 | C2 | 10/1996 |
| DE | 20004959 | U1 | 6/2000 |
| DE | 20313772 | U1 | 12/2003 |
| EP | 0917890 | A2 | 5/1999 |
| EP | 2512758 | A2 | 10/2012 |
| EP | 2532927 | A2 | 12/2012 |
| ES | 2151390 | A1 | 12/2000 |
| FR | 1180387 | A1 | 6/1959 |
| FR | 2755865 | A1 | 5/1998 |
| FR | 2831065 | A1 | 4/2003 |
| FR | 2846888 | A1 | 5/2004 |
| FR | 2939050 | A1 | 6/2010 |
| GB | 2314512 | A | 1/1998 |
| JP | 05-500760 | | 2/1993 |
| JP | 1022334 | | 10/1998 |
| JP | 11-113988 | A | 4/1999 |
| JP | 2001-112886 | | 4/2001 |
| JP | 2002-28202 | A | 1/2002 |
| JP | 2004-073445 | A | 3/2004 |
| JP | 2004329365 | A | 11/2004 |
| JP | 2004353439 | A | 12/2004 |
| JP | 1395000 | | 8/2010 |
| JP | 1421980 | | 8/2011 |
| JP | 2012-214936 | A | 11/2012 |
| KR | 20030086404 | | 11/2003 |
| TW | M339250 | | 9/2008 |
| WO | WO96/31256 | A1 | 10/1996 |
| WO | WO99/30271 | A1 | 6/1999 |
| WO | WO01/24900 | A1 | 4/2001 |
| WO | WO02/098516 | A1 | 12/2002 |
| WO | WO2004/080365 | A1 | 9/2004 |
| WO | WO2004/103176 | A1 | 12/2004 |
| WO | WO2007/038888 | A1 | 4/2007 |
| WO | WO2007/115565 | A2 | 10/2007 |
| WO | WO2008/030366 | A2 | 3/2008 |
| WO | WO2008/058567 | A1 | 5/2008 |
| WO | WO2009/151630 | A1 | 12/2009 |
| WO | WO2011/089632 | A1 | 7/2011 |
| WO | WO2011/112898 | A1 | 9/2011 |
| WO | WO2012/107700 | A2 | 8/2012 |
| WO | WO2012/118143 | A1 | 9/2012 |
| WO | WO2013/019956 | A1 | 2/2013 |
| WO | WO2013/021709 | A1 | 2/2013 |
| WO | WO2014/138228 | A1 | 9/2014 |
| WO | WO2015/195983 | A1 | 12/2015 |

OTHER PUBLICATIONS

Capó-Lugo et al.; Maximum walking speeds obtained using treadmill and overground robot system in persons with post-stroke hemiplegia; J NeuroEng Rehabil.; 9(80); 14 pgs.; Oct. 2012.

Díaz et al.; Lower-Limb Robotic Rehabilitation: Literature Review and Challenges; Hindawi Pub. Corp.; Journal of Robotics; vol. 2011; Art. ID 759764; 11 pgs.; (accepted for publn.) Sep. 2011.

Hamilton; Low-Tech Alternative to AlterG on Market; Runner's World; 2 pgs.; Aug. 16, 2012; (printed from internet: http://www.runnersworld.com/elite-runners/low-tech-alternative-alterg-market).

Kawai et al.; Rehabilitation apparatus for treadmill walking using lower body positive pressue (Japanese & English abstracts); Aerospace and Environmental Medicine; vol. 44; No. 4; (year of pub. sufficiently earlier than effective US filing date and any foreign priority date) 2007.

Lillegard, R.; Running on air (retrieved Aug. 10, 2016 from the internet: http://www.lightspeedrunningandrehabilitation.com/in-the-news/running-on-air#more-89); Duluth Superior Magazine; 3 pgs.; Jul. 2, 2012.

Pates, K.; Duluth physical therapist develops running aid; (retrieved Aug. 10, 2016 from the internet: http://www.lightspeedrunningandrehabilitation.com/in-the-news/duluth-physical-therapist-develops-running-aid#more-9 2); Duluth News Tribune; 3 pgs.; Jul. 25, 2012.

Patton et al.; KineAssist: Design and development of a robotic overground gait and balance therapy device; Top Stroke Rebabil.; 15(2); pp. 131-139; Mar.-Apr. 2008.

Whalen et al.; Design U.S. Appl. No. 29/337,097 entitled "Adjustable Positive Pressure Support System," filed May 14, 2009.

Whalen et al.; U.S. Appl. No. 15/046,358 entitled "System, method and apparatus for applying air pressure on a portion of the body of an individual," filed Feb. 17, 2016.

Whalen et al.; U.S. Appl. No. 15/143,351 entitled "Systems, methods and apparatus for differential air pressure devices," filed Apr. 29, 2016.

Long et al.; U.S. Appl. No. 15/319,629 entitled "Pressure chamber and lift for differential air pressure system with medical data collection capabilities," filed Dec. 16, 2016.

Kuehne et al.; U.S. Appl. No. 15/588,549 entitled "Differential air pressure systems," filed May 5, 2017.

Montion Control Tips; (retrieved from the internet: www.motioncontroltips.com/lead-screws/); 5 pgs; on Dec. 19, 2016.

* cited by examiner

SUPPORT FRAME AND RELATED UNWEIGHTING SYSTEM

CROSS REFERENCE TO RELATED APPLICATIONS

This application claims priority to U.S. Provisional Application No. 61/784,387, titled "Support Frame and Related Unweighting System," and filed Mar. 14, 2013, the entire contents of which are incorporated by reference herein.

INCORPORATION BY REFERENCE

All publications and patent applications mentioned in this specification are herein incorporated by reference to the same extent as if each individual publication or patent application was specifically and individually indicated to be incorporated by reference.

FIELD

The embodiments described herein relate to various types of systems used to at least partially support the weight of an individual using a piece of exercise equipment.

BACKGROUND

Methods of counteracting gravitational forces on the human body have been devised for therapeutic applications as well as physical training. Rehabilitation from orthopedic injuries or neurological conditions often benefits from precision unweighting (i.e. partial weight bearing) therapy.

One way to unweight is to use a frame with elastic cords. Existing such systems are simple affairs, often relying on stretched bungee cords to provide the necessary unweighting forces. The unweighting force provided by existing elastic cord systems is often poorly controlled, varying from cord to cord, over time, and with usage. In addition to a lack of repeatability, the inability to display unweighting force with existing systems further prevents users from comparing current workouts with previous workouts. Furthermore, inability to easily adjust unweighting force requires users to dismount from the system to change settings. Frames are typically designed to be entered from the side, making close packing of systems over treadmills in a fitness club environment impractical. Also, these systems must typically be manually adjusted for differing user heights, complicating the usage process.

Another way to counteract the effects of gravity is to suspend a person using a body harness in conjunction with inelastic cords or straps to reduce ground impact forces. However, currently available harness systems are often uncomfortable and require suspension devices or systems that lift the user from above the user's torso. Such systems distribute weight unnaturally and uncomfortably on the user's body. The weight distribution can interfere with natural movements due to issues such as penduluming, quickly tightening/loosening, tilting the body, etc. In some cases, prolonged use with these harness suspension systems can result in injuries that range from mild skin abrasion or contusions or musculo-skeletal injury. In attempting to address the discomfort and limited mobility induced by such inelastic systems, some harness systems employ the use of bungee or elastic tensioning cords that need to be hooked and unhooked or manually stretched to adjust the degree of unweighting experienced. Such adjustment is cumbersome, inconvenient, and dangerous as the user may lose control of the tensioned cords during adjustment, causing the cords to strike the user with a substantial amount of force. All such overhead cord system do not constrain users from side-to-side or fore-and-aft motion, requiring users to focus on maintaining their position in space.

Other systems for unweighting a user have been developed. In one such system, a portion of a user's body is submerged into a water-based system to thereby permit buoyancy provided by the water offset gravity. However, both the upward supporting force and the effective point where the force is applied provided by such water-based systems is dependent on the depth to which the user's body is submerged below the water surface, making unweighting force adjustability and natural weight distribution difficult to achieve, at best. Moreover, the viscous drag of the water may substantially alter the muscle activation patterns of the user. Users with open wounds, casts, splints, or other encumbrances are also not able to use water-based therapy.

Differential Air Pressure (DAP) systems have been developed to use air pressure in, for example, a sealed chamber to simulate a low gravity effect and support a patient at his center of gravity without the discomfort of harness systems or the inconvenience of water-based therapies. DAP systems generally utilize a chamber for applying differential air pressure to a portion of a user's body. While useful in training a wide variety of patient types, DAP systems have control systems to monitor and/or maintain pressure levels, pressure enclosures and the like to varying degrees based on the electrical and mechanical designs and complexity of the system, all of which add to the cost of such systems.

In view of the above shortcomings and complications in the existing unweighting systems, there remains a need for simple yet effective unweighting systems. In particular, for an average user who may not have a medical condition warranting physical therapy or medical supervision, there is also an additional need for unweighting systems suited to gym or home use. As such, a need exists for an unweighting system that allows users economical and effective alternatives to the current techniques available.

SUMMARY OF THE DISCLOSURE

In general, in one embodiment, an unweighting system includes a frame, a pair of front pulleys, a pair of rear pulleys, a first cable, and a second cable. The frame is configured to be attached to or placed at least partially around an exercise device and includes a front portion and a rear portion. The pair of front pulleys is coupled to the front portion. The pair of rear pulleys is coupled to the rear portion. A first cable passes through a first of the pair of front pulleys and through a first of the pair of rear pulleys. A second cable passes through a second of the pair of front pulleys and through a second of the pair of rear pulleys. The first and second cables are configured to couple with a user to unload a portion of the user's weight as the user exercises on the exercise device. The first and second cables are mounted to the front portion of the frame at front attachment points below the front pulleys and below a waist of the user when the user is coupled with the first and second cables.

In general, in one embodiment, an unweighting system includes a frame, a pair of front pulleys, a pair of rear pulleys, a first cable, and a second cable. The frame is configured to be attached to or placed at least partially around an exercise device. The frame includes a front portion and a rear portion. The pair of front pulleys is coupled to the front portion. The pair of rear pulleys is coupled to the rear portion. A first cable passes through a first of the pair of front pulleys and through a first of the pair of rear pulleys. A second cable passes through a second of the pair of front pulleys and through a second of the pair of rear pulleys. The first and second cables are configured to couple with a user to unload a portion of the user's weight as the user exercises on the exercise device. The first and second cables are configured to cross one another between the front portion and the rear portion of the frame so as to cross in front of or behind the user when the user is coupled with the first and second cables.

In general, in one embodiment, an unweighting system includes a frame, a pair of front pulleys, a pair of rear pulleys, a first cable, a second cable, and a connector attaching the first cable and the second cable together. The frame is configured to be attached to or placed at least partially around an exercise device. The frame includes a front portion and a rear portion. The pair of front pulleys is coupled to the front portion. The pair of rear pulleys is coupled to the rear portion. The first cable passes through a first of the pair of front pulleys and through a first of the pair of rear pulleys. The second cable passes through a second of the pair of front pulleys and through a second of the pair of rear pulleys. The first and second cables are configured to couple with a user to unload a portion of the user's weight as the user exercises on the exercise device. The connector attaches the first cable and the second cable together between the front portion and the rear portion of the frame so as to connect the cables in front of or behind a user when the user is coupled with the first and second cables.

In general, in one embodiment, an unweighting system includes a frame, a pair of front pulleys, a pair of rear pulleys, a first cable, and a second cable. The frame is configured to be attached to or placed at least partially around an exercise device. The frame includes a front portion and a rear portion. The rear portion includes a pair of pivotable arms. The pair of front pulleys is coupled to the front portion. The pair of rear pulleys is coupled to the pivotable arms. The first cable passes through a first of the pair of front pulleys and through a first of the pair of rear pulleys. The second cable passes through a second of the pair of front pulleys and through a second of the pair of rear pulleys. The first and second cables are configured to couple with a user to unload a portion of the user's weight as the user exercises on the exercise device. The pivotable arms are configured to pivot between a first position and a second position to move the first and second cables away from and closer to a central longitudinal axis of the system.

In general, in one embodiment, an unweighting system includes a frame, a pair of front pulleys, a pair of rear pulleys, a first cable, a second cable, a first lower load cell, a second lower load cell, a first upper load cell, a second upper load cell, and a controller. The frame is configured to be attached to or placed at least partially around an exercise device. The frame includes a front portion and a rear portion. The pair of front pulleys is coupled to the front portion. The pair of rear pulleys is coupled to the rear portion. The first cable passes through a first of the pair of front pulleys and through a first of the pair of rear pulleys. The second cable passes through a second of the pair of front pulleys and through a second of the pair of rear pulleys. The first and second cables are configured to couple with a user to unload a portion of the user's weight as the user exercises on the exercise device. The first lower load cell is connected to an end of the first cable. The second lower load cell is connected to an end of the second cable. The first upper load cell is connected to the first of the pair of front pulleys or the first of the pair of rear pulleys. The second upper load cell connected to the second of the pair of front pulleys or the second of the pair of rear pulleys. The controller is in communication with the load cells and is configured to obtain data from the load cells to determine an amount of unloading of the user when the user is coupled to the first and second cables.

In general, in one embodiment, an unweighting system includes a frame, a pair of front pulleys, a pair of rear pulleys, a first cable, and a second cable. The frame is configured to be attached to or placed at least partially around an exercise device. The frame includes a front portion and a rear portion. The pair of front pulleys is coupled to the front portion. The pair of rear pulleys is coupled to the rear portion. A first cable passes through a first of the pair of front pulleys and through a first of the pair of rear pulleys. A second cable passes through a second of the pair of front pulleys and through a second of the pair of rear pulleys. The first and second cables are configured to couple with a user to unload a portion of the user's weight as the user exercises on the exercise device. Each of the first cable and the second cable includes a plurality of sections. At least two of the plurality of sections are more lubricious than other sections so as to reduce friction between the cable and the pulleys at those at least two sections.

In general, in one embodiment, an unweighting system includes a frame, a pair of front pulleys, a pair of rear pulleys, a first cable, a second cable, a first resilient member, a second resilient member, and at least one winch. The frame is configured to be attached to or placed at least partially around an exercise device. The frame includes a front portion and a rear portion. The pair of front pulleys is coupled to the front portion. The pair of rear pulleys is coupled to the rear portion. The first cable passes through a first of the pair of front pulleys and through a first of the pair of rear pulleys. The second cable passes through a second of the pair of front pulleys and through a second of the pair of rear pulleys. The first and second cables are configured to couple with a user to unload a portion of the user's weight as the user exercises on the exercise device. The first resilient member is attached to a first end of the first cable, and the second resilient member is attached to a first end of the second cable. The at least one winch is coupled to second ends of the first and second cables and is configured to control an amount of unloading provided by the cables and the resilient members when the user is coupled with the first and second cables and exercises on the exercise device.

Any of these embodiments can include one or more of the following features. The first and second cables can be configured to cross one another directly adjacent to the user when the user is coupled with the first and second cables. The first and second cables can be configured to cross one another both in front of and behind the user when the user is coupled with the first and second cables. The connector can be configured to sit directly adjacent to the user when the user is coupled with the first and second cables. The pivotable arms can be configured to provide unobstructed access to the system when in the first position. The cables can be configured to be substantially adjacent to the user when the pivotable arms are in the second position. The unweighting system can further include third and fourth lower load cells connected to ends of the first and second cables opposite to the ends connected to the first and second lower load cells. The unweighting system can further include first and second resilient members connected to ends of the first and second cables opposite to the ends connected to the first and second lower load cells. The unweighting system can further include third and fourth upper load cells such that each of the pulleys includes an upper load cell connected thereto. Each pulley can be mounted to a load cell piston to indicate force acting on the pulley. The controller can be configured to determine an amount of unloading of the user by determining a difference in readings between the upper load cells and the lower load cells. There can be two winches—a first winch attached to the second end of the second end of the first cable and a second winch attached to the second end of the second cable. The system can further include a cable attachment configured to attach the second ends of the first and second cables, and the at least one winch can be coupled to the cable attachment.

Any of these embodiments can include one or more of the following features. The system can further include a first resilient member attached to the first cable and a second resilient member attached to the second cable. The resilient members can be coiled springs. The frame can include at least two upright bars, and each resilient member can be positioned within an upright bar. The front portion can include a pair of front vertical bars, and the rear portion can include a pair of rear vertical bars. The pair of front vertical bars or the pair of rear vertical bars can include a height adjustment mechanism therein. The pair of front pulleys can be spaced close to the central longitudinal axis of the exercise equipment. The pair of rear pulleys can be spaced farther apart than the pair of front pulleys. The position of the front pulleys or the rear pulleys on the frame can be adjustable. The rear pulleys can be positioned at a greater height above the exercise equipment than the front pulleys are positioned above the exercise equipment. The pair of rear pulleys can be spaced far enough apart from the central longitudinal axis of the system to allow a user to walk between the pair of rear pulleys. The system can further include a user attachment mechanism coupled to each cable for releasably attaching a user to the cable. The attachment mechanism can be configured to allow the user to slideably attach to the cables.

In general, in one embodiment, an exercise system includes a frame sized for placement about a piece of exercise equipment, a pair of front rollers coupled to a front portion of the frame a pair of rear rollers coupled to a rear portion of the frame, a first cable passing through a first of the pair of front rollers and through a first of the pair of rear rollers, a second cable passing through a second of the pair of front rollers and through a second of the pair of rear rollers, a first resilient member attached to the frame and the first cable, and a second resilient member attached to the frame and the second cable.

Any of these embodiments may include one or more of the following features. In one aspect, the pair of front rollers can be spaced close to the longitudinal centerline of the exercise equipment. In one aspect, the pair of rear rollers can be spaced farther apart than the pair of front rollers. In another aspect, the position of the front rollers or the rear rollers can be adjustable such as through a motorized height adjustment mechanism. In another aspect, the rear rollers can be positioned at a greater height above the exercise equipment than the front rollers are positioned above the exercise equipment. In yet another aspect, the resilient member can be a spring. In a further aspect, the first and the second resilient members can be adjustable to have at least two different response modes. In still another aspect, the two different response modes can be for permitting a user to attach to the first cable and the second cable. In yet another aspect, the two different response modes can be for at least partially unweighing relative to the exercise equipment a user attached to the first cable and the second cable. In an additional aspect, the first end of the first cable and the second cable can be fixed to a portion of the support frame. In another aspect, the first end of the first cable and the second cable can be connected to a motor, a winch or a spool. In a further aspect, the support frame can include a first moveable arm and a second moveable arm, where the first cable is supported at least in part by a portion of the first moveable arm and the second cable is supported at least in part by a portion of the second moveable arm. In another aspect, the system can include an attachment device on each cable for releasably attaching a user to the cable. In yet another aspect, the system can include a frame connected between the first and second cables having an opening to receive a user. In yet another aspect, the system can include a fastener from the frame for coupling to a user's garment.

In general, in another embodiment, an exercise system includes a frame having four upright members sized and spaced for placement about a piece of exercise equipment, a load cell and roller assembly supported by the upper portion of each upright member, a load cell assembly coupled to the lower portion of each upright member, a support frame for being releasably attached to a user configured for unweighting the user while using the exercise equipment, and a plurality of cables. One of the plurality of cables connects each load cell assembly to the support frame while also passing over the load cell and roller assembly.

Any of these embodiments can include one or more of the following features. In one aspect, the system can include a pair of rear rollers spaced far enough apart from the longitudinal centerline to allow a user to walk between the pair of rear rollers. In another aspect, the system includes a controller in communication with the output of each of the load cells and computer readable code containing instructions for interpreting the collective outputs of the load cells to determine the amount of unweighting for a user supported over the exercise equipment using the support frame.

In general, in one embodiment, an unweighting exercise system can include a frame configured to be attached to or placed at least partially around an exercise device. The frame includes a front portion and a rear portion, A pair of front pulleys is coupled to the front portion, and a pair of rear pulleys is coupled to the rear portion. A first cable passes through a first of the pair of front pulleys and through a first of the pair of rear pulleys, and a second cable passes through a second of the front pulleys and through a second of the rear pulleys. The first and second cables end in a weight stack. The first and second cables are configured to couple with a user. A portion of the user's weight is unloaded by the cables and/or the weight stack as the user is coupled to the cables and exercises on the exercise device.

Any of these embodiments can include one or more of the following features. A resilient member can be placed in the cable to dampen the unweighting force, such as to dampen the force between the weight stack and the user.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

DETAILED DESCRIPTION

Described herein are unweighting systems including a pair of cables configured to unweight a user attached to the cables, such as while the user runs on an exercise device.

Figure 1:
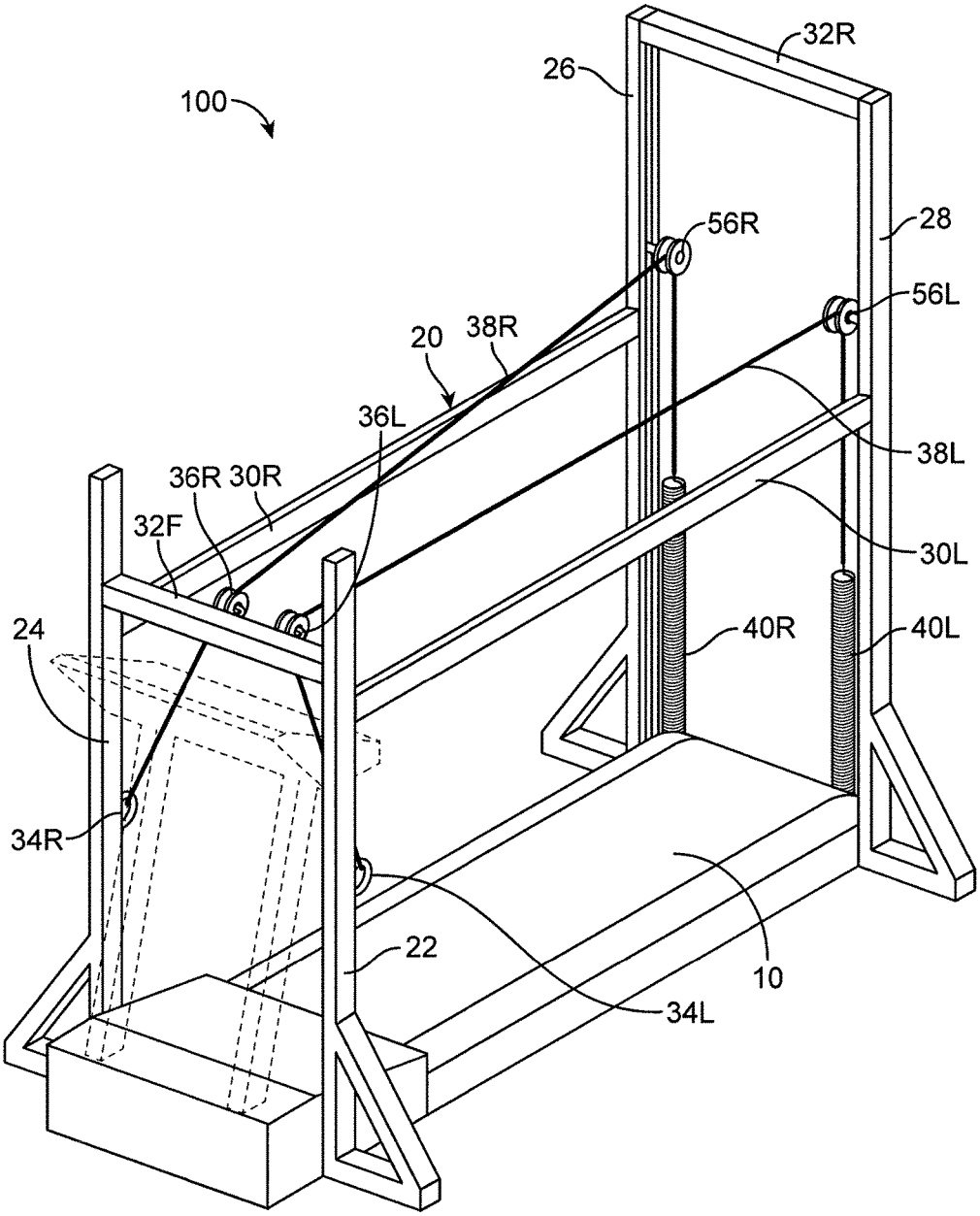
FIG. 1 is a perspective view of a support frame and a cable based unweighing system having a fixed front cable attachment and a variable loaded rear cable attachment.

FIG. 1 is a perspective view of an exemplary cable unweighting system 100 for use with an exercise device, such as a treadmill 10. The unweighting system 100 includes a support frame 20 and pair of cables 38R,L connected to a fixed front cable attachment and a variable loaded rear cable attachment. The support frame 20 includes uprights 22, 24, 26 and 28 that are joined by front and rear cross supports 32F, 32R and left and right longitudinal supports 30L, 30R. The front cross support 32F is shorter than the rear cross support 32R, which can be high enough to allow a user to pass thereunder without having to duck under or bump one's head on the support 32R. Further, the left and right longitudinal supports 30L, R can be configured to sit between a user's hips and a user's torso to provide arm rests or support during exercise.

A pair of front pulleys 36R, 36L is attached to the front cross support 32F while each of a pair of rear pulleys 56R,L is attached to the rear upright members 26, 28. Further, each front upright 24, 22 includes an anchor 34R,L, such as an eyelet, to receive anchor one of the cables 38L,R. The cables 38L,R can thus extend from the anchors 34R,L through the front pulleys 36L,R, and through the rear pulleys 56R,L. The anchors 34R,L can be positioned below the front pulleys 36R,L. In some embodiments, the anchors 34L,R are also configured to sit below the hips or waist of the user. Further, the front pulleys 36L,R can be configured to be positioned above the waist of a user, such as between the hips and torso of the user. The rear pulleys 56L,R can be higher than the front pulleys 36L, 36R and can be positioned at a wider spacing than the front pulleys 36L,R. The wider spacing advantageously permits easier access onto the treadmill and to the support frame interior. The cables 38L,R can span the length of the treadmill 10 between the front pulleys 36L,R and the rear pulleys 56L,R at a position substantially between the user's hips and torso.

The cables 38L,R can each end at the rear of the treadmill 10 at a counterforce member 40L,R, such as a coil spring. That is, at the rear frame, the rear pulleys 56L,R direct each of the cables 38L,R down to a counterforce member 40L,R. The counterforce member 40L,R may be fixed to the frame, such as to rear uprights 26, 28. The counterforce member 40L,R may be any suitable resilient member suited to the loading characteristics desired on the cable 38. Representative counterforce members 40 may be any of a wide variety of resilient members or one or more springs (e.g., coiled springs) with the same or different loadings, a shock absorber, a hydraulic ram, a motor driver or resilient members such as bands or bungee cords. In some embodiments, the amount of force provided by the counterforce members 40L,R can be adjustable. For example, in embodiments where the counterforce member 40L,R is a spring, the length of the spring (and thus the amount of compression of the spring) can be varied. This variation can in turn vary the amount of unloading experienced by the user.

Figure 2:
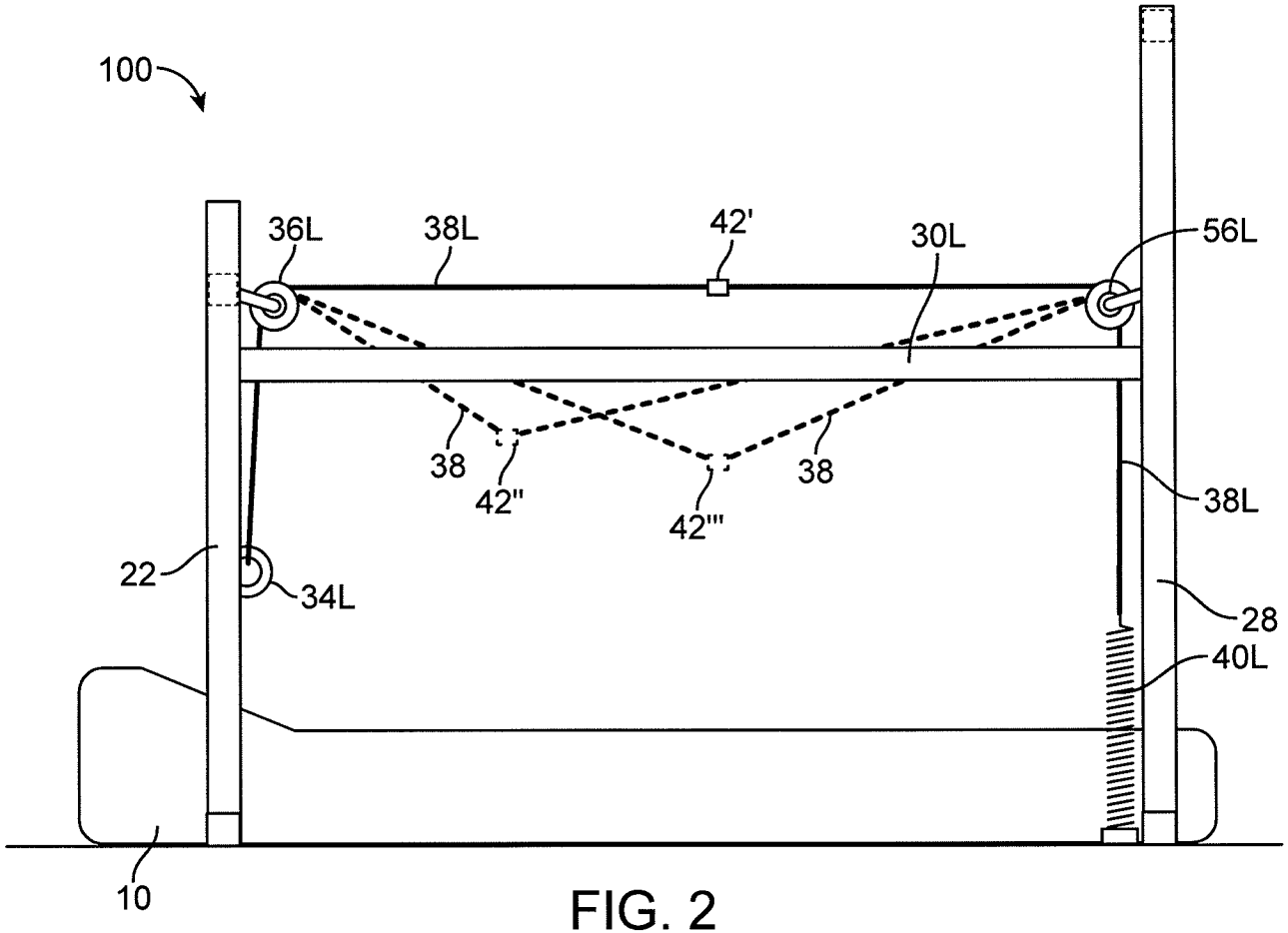
FIG. 2 is a side view of the system of FIG. 1 illustrating the cable displacement for different user exercise positions.

The cables 38R,L can be configured to allow attachment of a user along the length of the cables 38R,L between the front pulleys 36L,R and the rear pulleys 56R,L. For example, each of the cables 38R,L can include an attachment mechanism such as an eyelet, hook, or clip, configured to mate with an attachment element on a user garment. As another example, the cable can include a lubricious surface configured to allow a roller on a user garment to roll or slide more easily. In some embodiments, the cables 38R,L can attach proximate to the hips of the user. When the user is attached to the cables 38R,L, the cable can displace vertically downward (e.g., to reach and support the user's hips). FIG. 2 is a side view of the system of FIG. 1 illustrating the cable displacement for different user positions. A neutral position is shown at 42'. A forward position is shown at 42". A rearward position is shown at 42'". A user may be positioned anywhere between the front and rear supports 32F,R. In some embodiments, the position of the user along the cable 38R,L can control the amount of unloading experienced by the user.

Figure 3A:
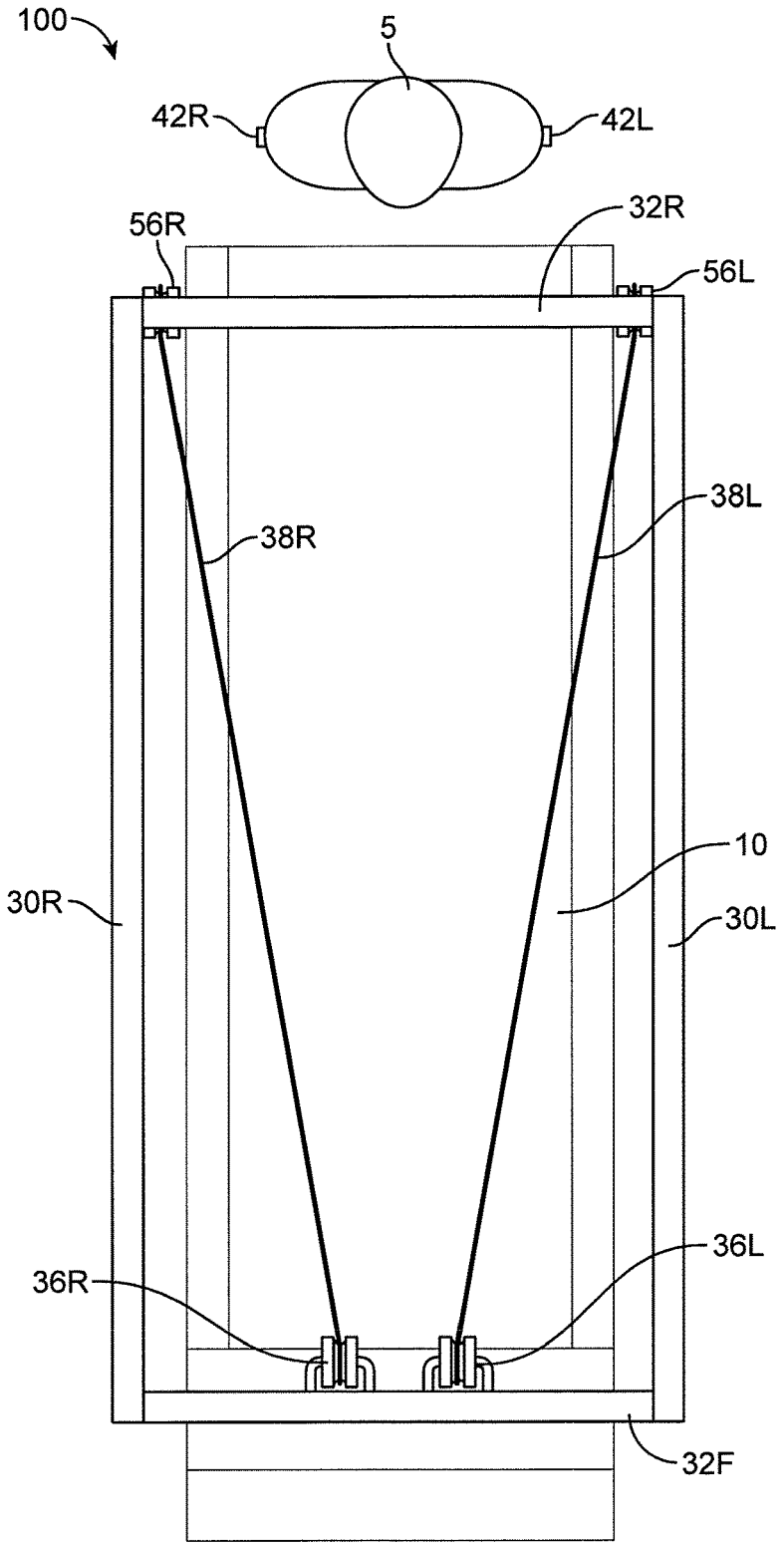
FIG. 3A is a top down view of a user approaching the rear portion of the system of FIG. 1.
Figure 3B:
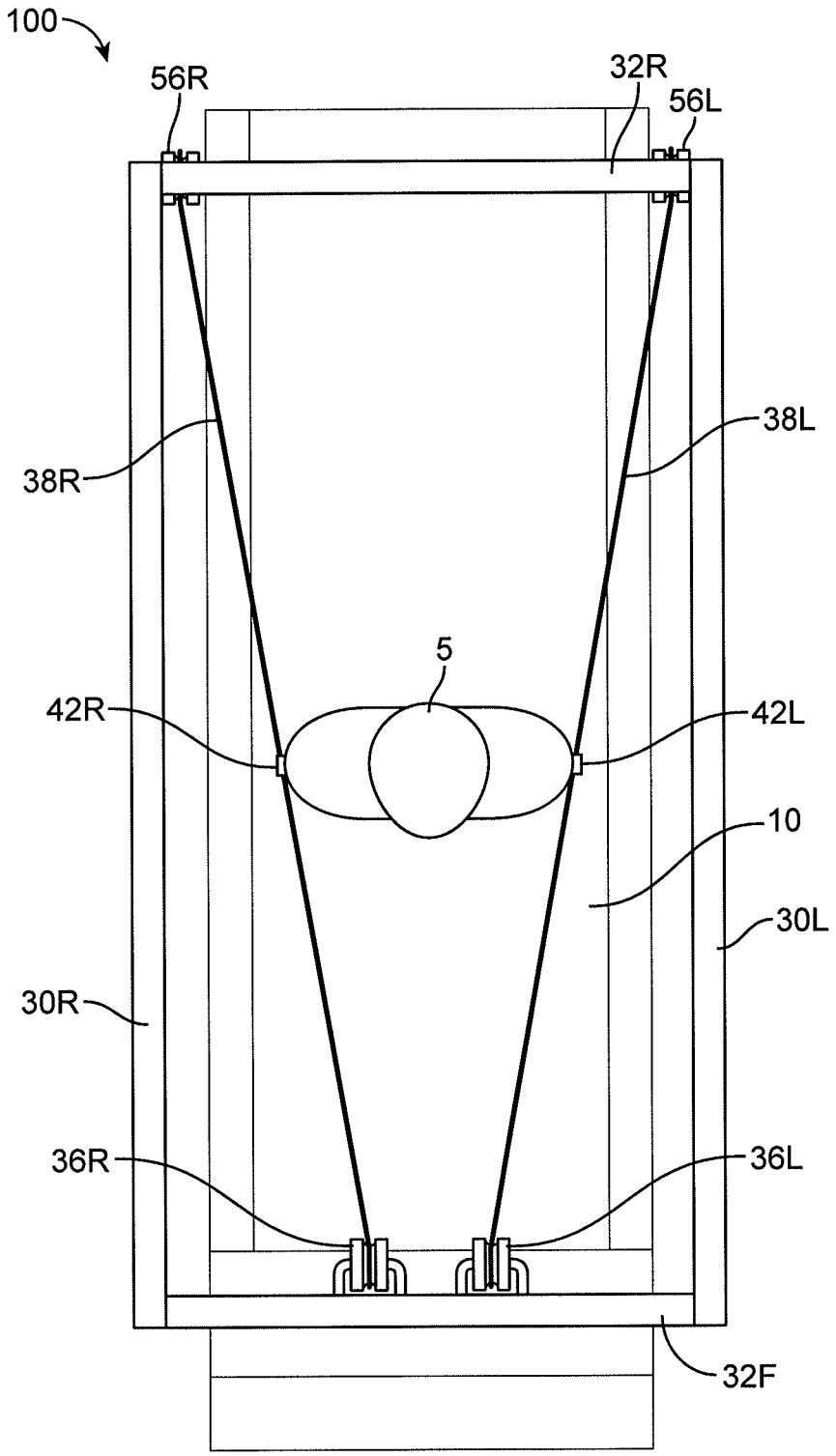
FIG. 3B is a top down view of the user in FIG. 3A connected to the unweighting system cables.

FIGS. 3A-3B show use of the system 100 by a user 5. The user 5 can enter the system 100 from the rear. As shown in FIG. 3A, the pulleys 56R,L are wider than the user 5 and are far enough apart to allow the user 5 to comfortably enter the system 100 without interference by the cables 38L,R. As shown in FIG. 3B, the user 5 can walk on the treadmill towards the front until he or she reaches an attachment point on the cables 38L,R, such as a point where the attachment elements 42*a,b* on the user's shorts are vertically adjacent to the cables 38R,L. As shown, the cables 38L,R extend to points (pulleys 36L,R) that have a narrower distance therebetween than the width of the user 5. The user 5 can then couple to the cables 38*a,b*. The cables 38*a,b* can unload a portion of the user's weight as the user exercises on the treadmill 10.

Figure 9A:
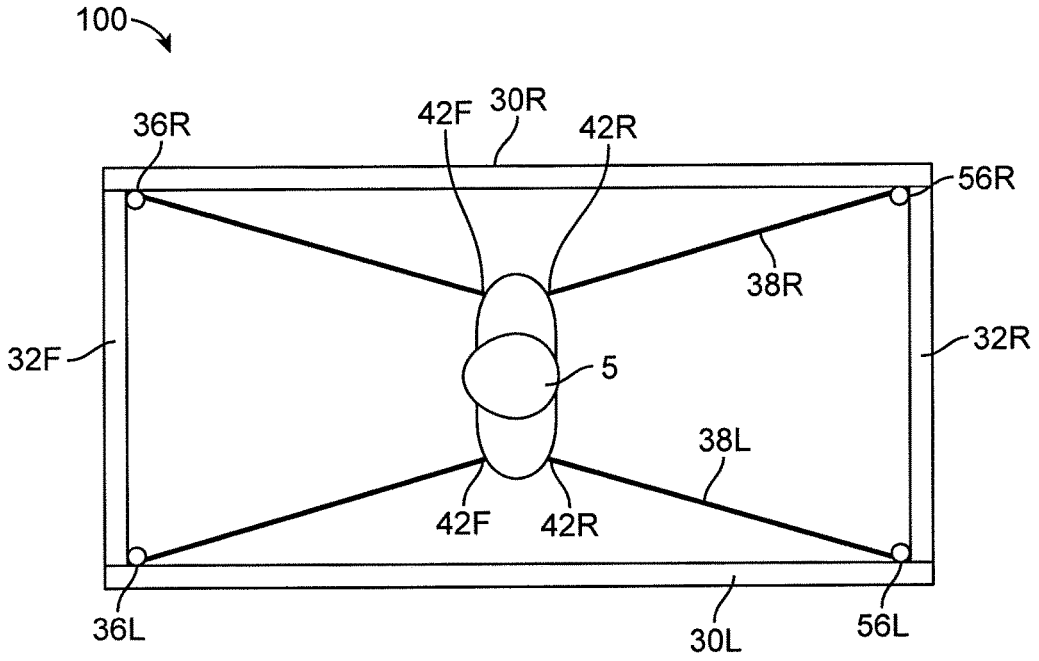
FIGS. 9A, 9B, 9C and 9D illustrate top down views of the cable geometry for widely spaced, narrowly spaced, and crossed cable orientations, respectively.
Figure 9B:
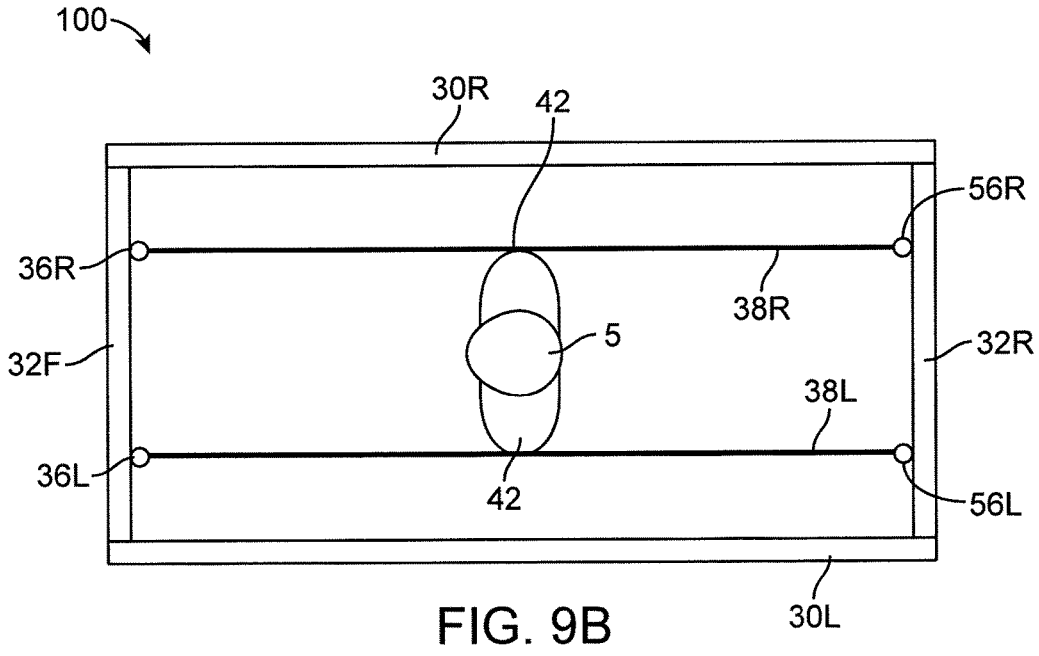

FIGS. 9A and 9B illustrate the system 100 with varying cable placements. In FIG. 9A, the front and rear pulleys 36L,R and 56L,R are both set wider than the waist connection location of the user 5. Two attachment points 42F, 42R, such as clips or hooks, can be used on each side of the user 5 to ensure that the cables 38L,R stay pulled in towards the user 5, as shown in FIG. 9A. FIG. 9B illustrates a view where the front and rear pulleys 36L,R, 56L,R are placed at the same general rear and forward spacing, and the cables 38L,R extend substantially straight. The distance between each of the front pulleys 36L,R and each of the rear pulleys 56L,R can be substantially the width of the user's waist. Thus, the distance between the cables 38L,R can remain substantially the same distance apart along the entire length of the system 100. In this embodiment, the user 5 can be attached to the cables 38L,R using a single attachment point 42.

Figure 3C:
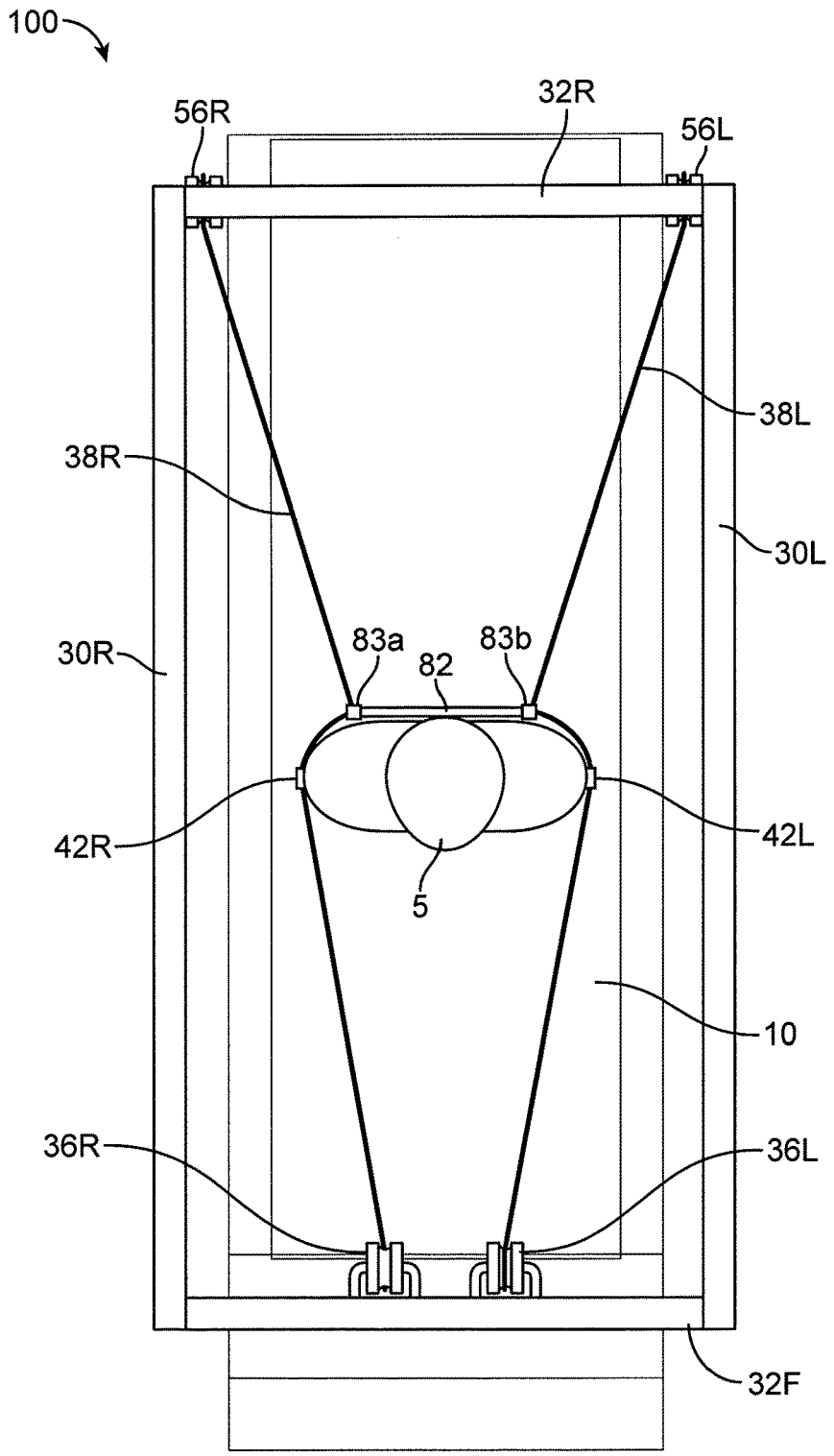
FIG. 3C is a top down view of the user in FIG. 3B with an additional cable connector shown in use to improve the rearward running envelope.
Figure 3D:
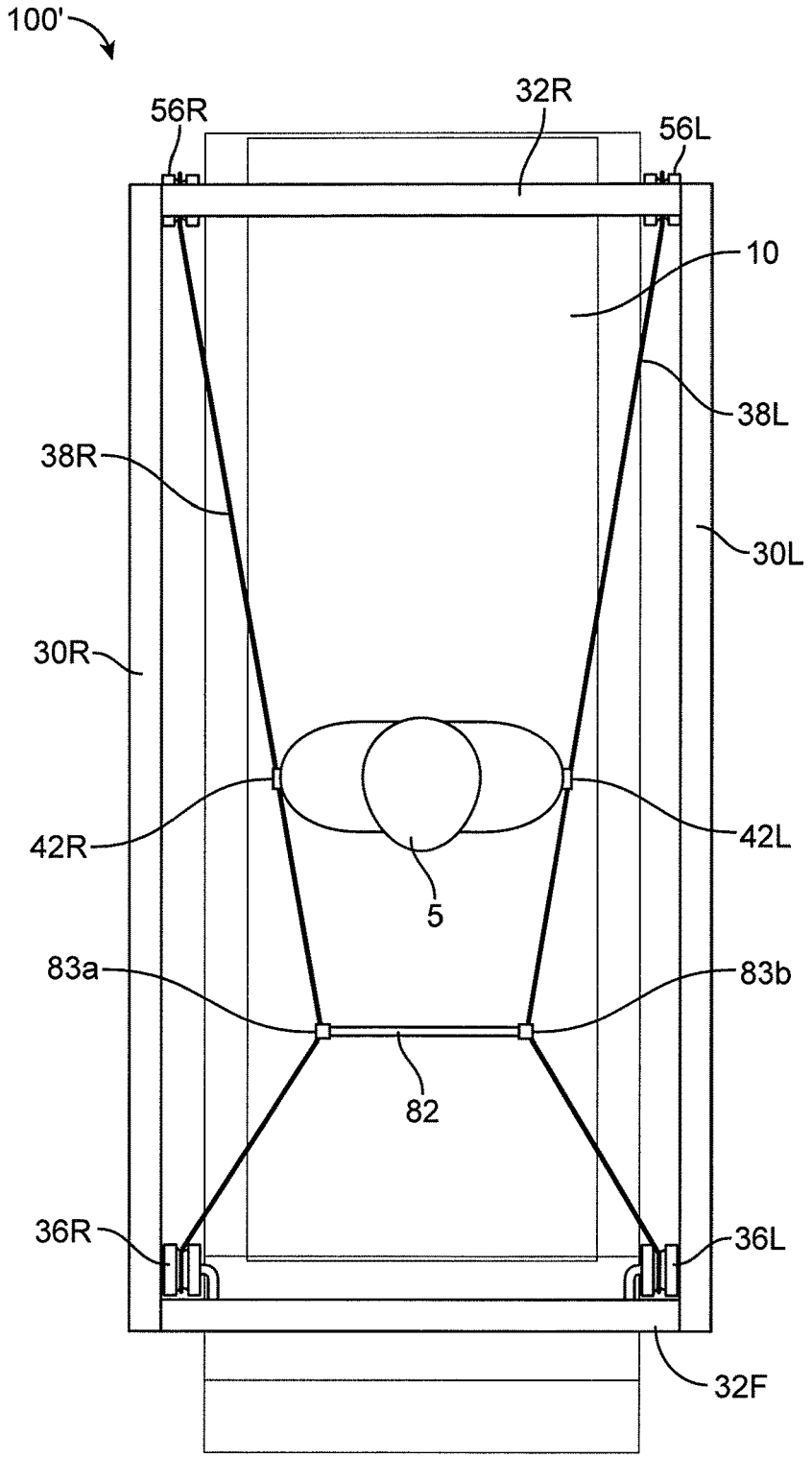
FIG. 3D is a top down view of the user in FIG. 3B with the cable connector of FIG. 3C shown in position to improve the forward running envelope.

FIGS. 3C and 3D show unweighting system 100 with a cable connector 82, such as a cable, jumper, or rigid member, between the cables 38L, 38R to improve the running envelope. Referring to FIG. 3C, the connector 82 can be used to pull the cables 38L,R closer together behind the user 5. That is, wider rear cable connections and support frame configurations accommodate entry into the support frame interior by the user. However, wider cable positions result in wide cable positions behind the user that can interfere with the user's running envelope. One technique to address cable encroachment into the running envelope is to confine the cables 38L,R in the area behind the user 5. Thus, the cable connector 82 can pull the cables 38L,R closer together and closer to the user 5. The cable connector 82 can thus be attached directly adjacent to and behind the user 5, as shown in FIG. 5C. Attachment mechanisms 83*a,b*, such as clips or hooks, can be used to connect the cables 83L,R to the connector 82. Likewise, referring to FIG. 3D, the connector 82 can be used to pull the cables 38L,R together in front of the user 5 to avoid interference of the cables 38L, 38R with the user's running form (e.g., the user's arm swing or leg movements). The connector 82 can thus be used improve the forward running envelope and/or the rearward running envelope. It is to be appreciated that two or more cable connectors 82 may be provided for further refinements to one or both of the forward or rearward running envelopes shown in FIGS. 3C and 3D. Likewise, a single system 100 can include connecters 82 in both the front and the back. In some embodiments, the cable connectors 82 can be used to constrain the cables 38L,R to run nearly parallel to the direction of the user's running/walking motion to increase arm swing clearance.

Figure 9C:
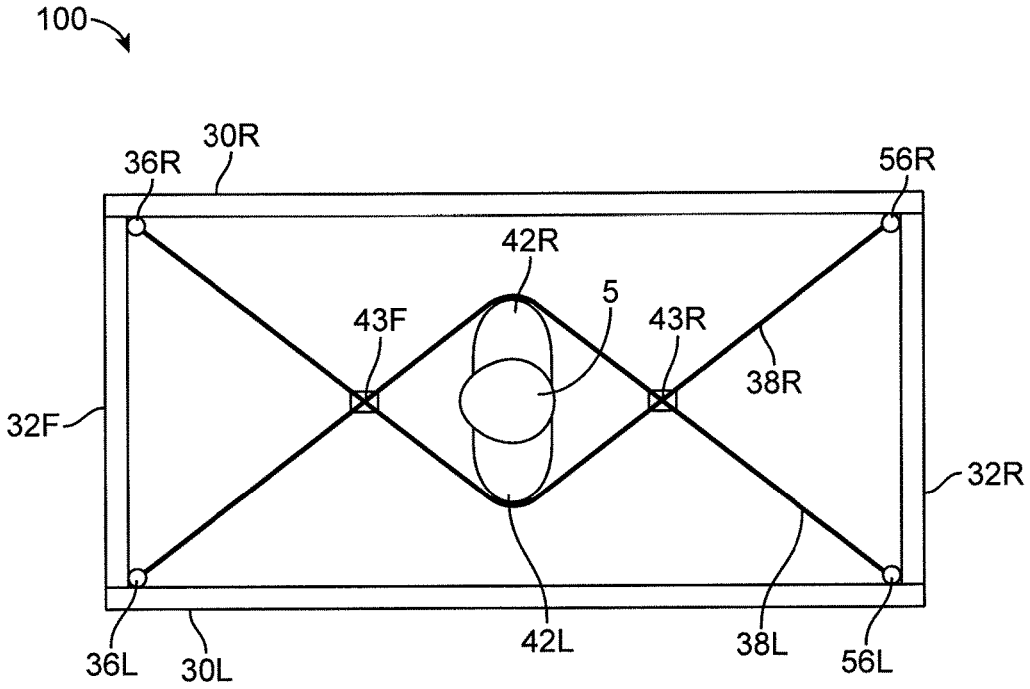
Figure 9D:
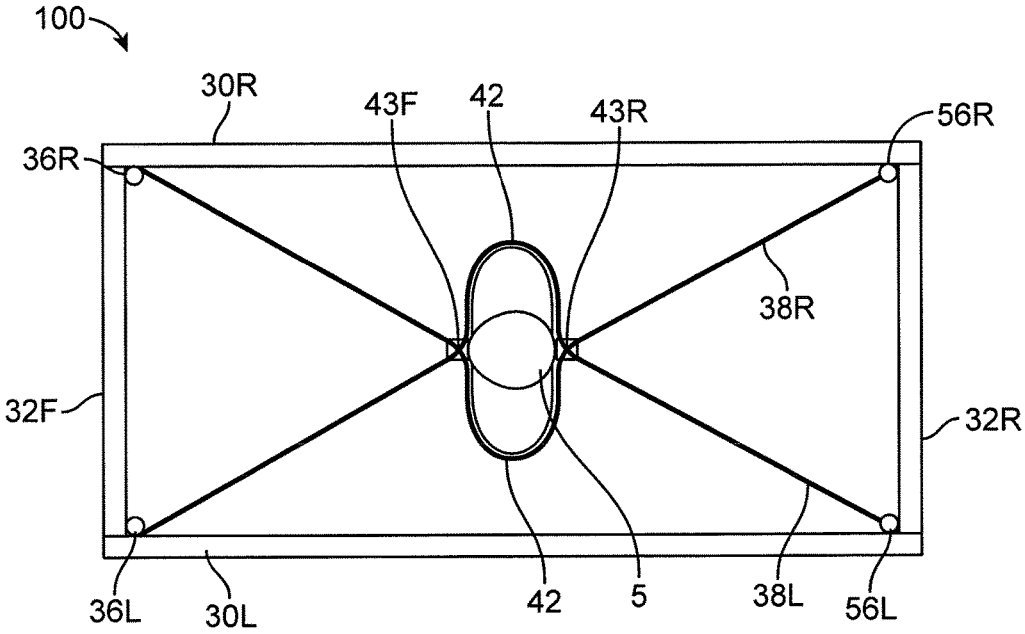

FIGS. 9C and 9D show the system 100 having cables 38L,R that cross between the front crossbar 32F and the rear crossbar 32R to improve the running envelope. As shown in FIG. 9C, the left cable 38L can extend from the left rear pulley 56L to a right attachment point 42R on the user 5 and back to the left front pulley 36L. Likewise, the right cable 38R can extend from the right rear pulley 56R to a left attachment point 42L on the user 5 back to the right front pulley 36R. The cables 38L, 38R can thus cross in front of and behind the user. In some embodiments, crossing clips 43F,R can be used to fix the crossing location. As shown in FIG. 9D, the crossing clips 43R,F can be pulled up directly adjacent to the user 5 such that the cables 38L,R form around the user 5, such as around the user's waist. In some embodiments, the attachment mechanism 42 can be a ring-style user support. Crossing the cables 38L,R as shown in FIGS. 9C and 9D can advantageously move the cables 38L,R out of the way of the user 5 as the user 5 runs or walks on the treadmill. That is, the user 5 may have a more natural arm swing with reduced chance of striking the cables 38L,R.

Figure 4:
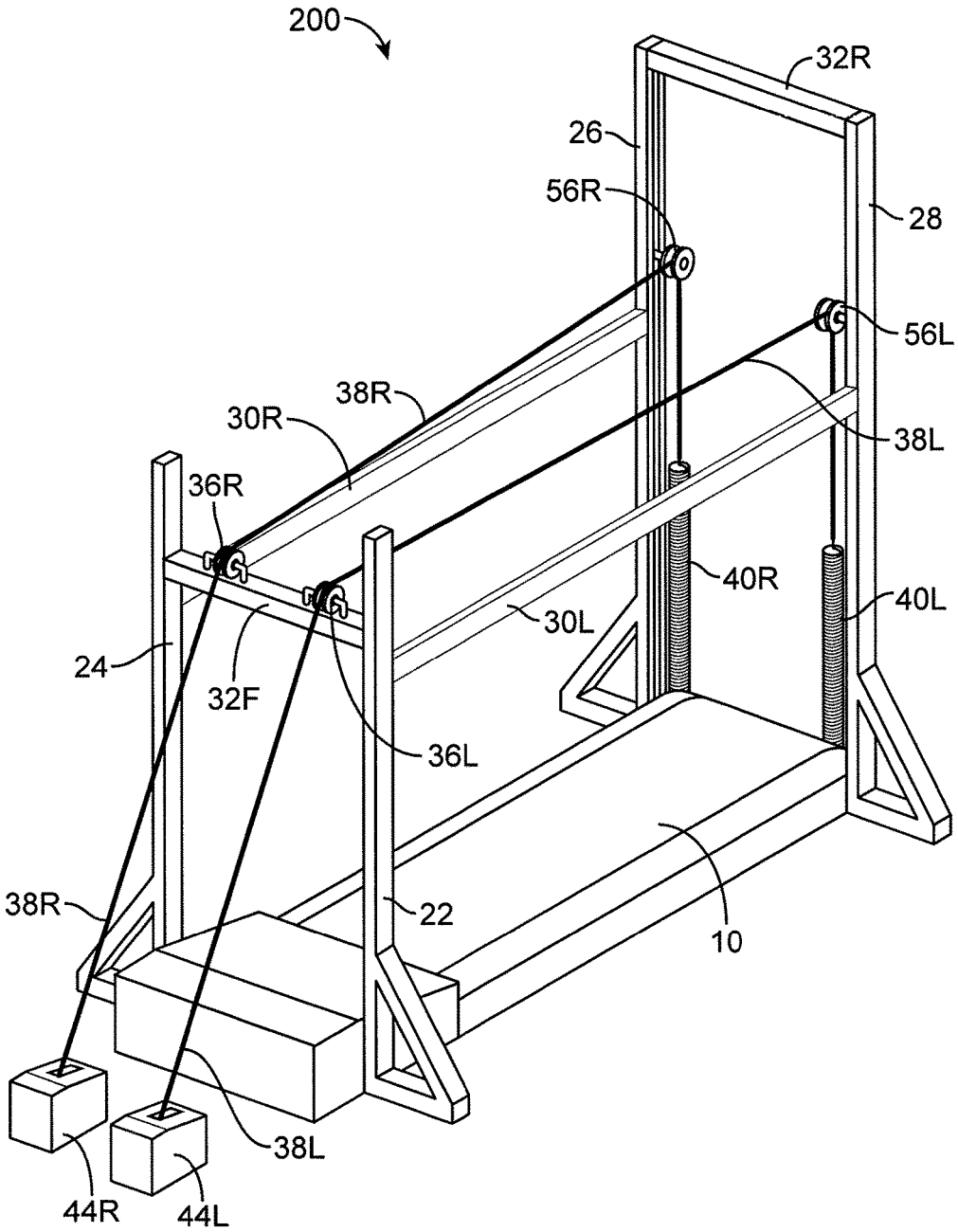
FIG. 4 is a perspective view of a support frame and a cable unweighting system with an individual motor or winch driven front cable attachment and a variable loaded rear cable attachment.

FIG. 4 is a perspective view of another cable unweighting system 200 for use with an exercise device, such as a treadmill 10. The system 200 is similar to the system 100, except that it includes a motor or winch system 44R, 44L attached to the end of each cable 38L,R (opposite to the counterforce members 40L,R) rather than having the cables 38L,R attach to anchor points on the uprights 24, 22. In this configuration, a single motor or winch 44L,R is used to pull on each cable 38L,R to counterbalance the counterforce members 40L,R. In one aspect, a suitable motor controller may be used to indicate or control the amount of force being provided to lift the user. The use of an electronic controller or motor controller may be useful in the repeatability and controllability of the user experience during and between sessions.

Figure 20:
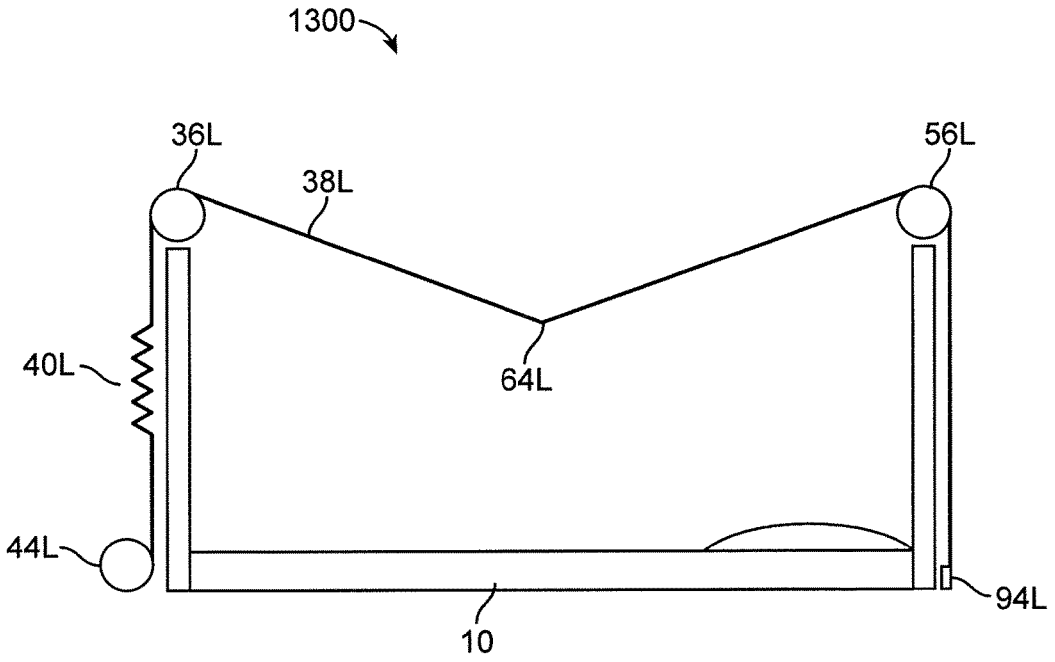
FIG. 20 is a simplified schematic of a cable unweighting system.

FIG. 20 is a schematic of another cable unweighting system 1300. System 1300 is similar to system 200 except that the resilient member 40R is placed between the winch 44L and the front pulley 36L. The cable 38L is thus attached to the rear by a fixed attachment element 94L. In this embodiment of an alternative unweighting system, the distance between the rear attachment element 94L and the user suspension point 64 remains fixed, allowing the user to remain largely stationary on the treadmill as the cable tension and unweighting force are adjusted.

Figure 5:
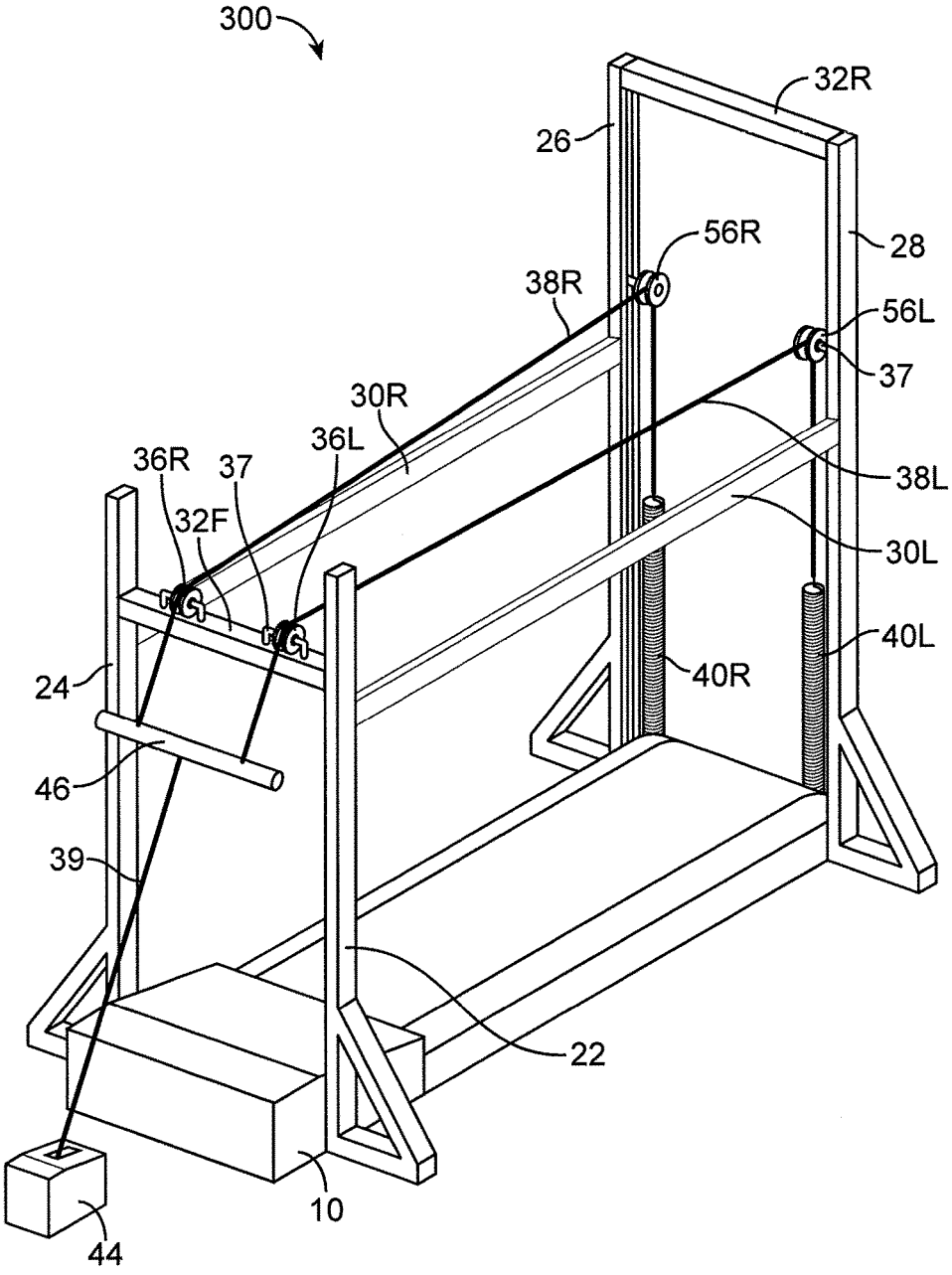
FIG. 5 is a perspective view of a support frame and a cable based unweighting system with a single motor or winch dual cable attachment and a variable loaded rear cable attachment.

FIG. 5 is a perspective view of another cable unweighting system 300 for use with an exercise device, such as a treadmill 10. The system 300 is similar to system 200 except that a single motor or winch 44 is used to pull on each cable 38L,R. The system 200 can include a cable attachment bar 46 attached to the ends of each cable 38L,R. The winch 44 can then be attached to the cable attachment bar 46, such as through an additional cable 39.

Figure 6:
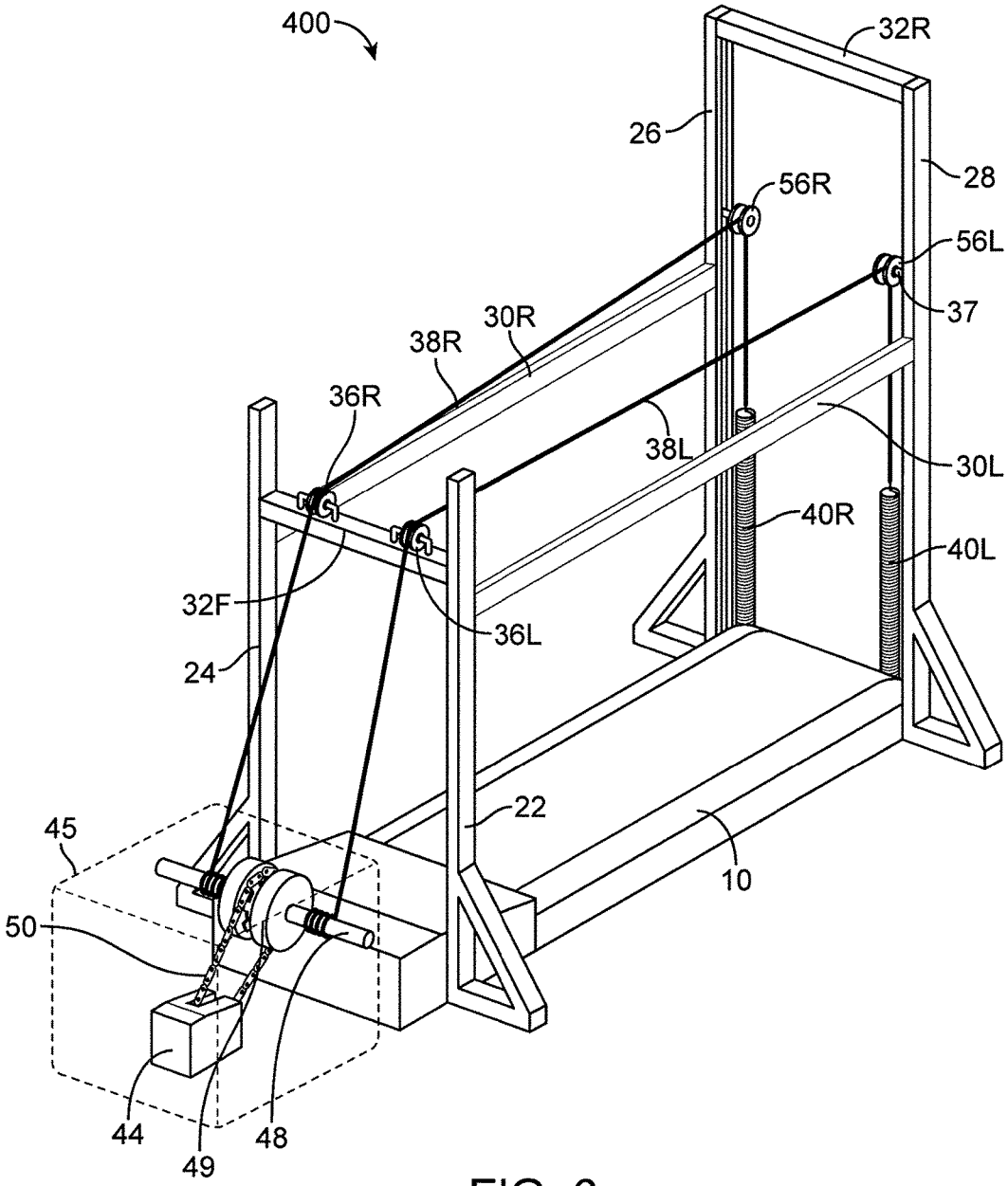
FIG. 6 is a perspective view of a support frame and a cable based unweighting system with a motor driven spool front cable attachment and a variable loaded rear cable attachment.

FIG. 6 is a perspective view of another cable unweighting system 400 for use with an exercise device, such as a treadmill 10. The system 400 is similar to the system 300 except that the winch is replaced with a motor and chain subassembly 45. The motor and chain subassembly 45 includes a pulley 49 attached to an axle 48. A chain 50 can extend around the pulley 49 and be connected to a motor 44. Further, the cables 38L,R can be attached to, and configured to wrap around, the 48. Thus, as the motor 44 rotates the pulley 49, the cables 38L,R can wrap around or unwrap from the axle 48. The wrapping and un-wrapping can increase or decrease tension or loading of the cables 38L,R, thereby increasing or decreasing the amount of unweighting experienced by the user. In some embodiments, the motor and chain subassembly 45 can be provided with an enclosure.

Figure 7:
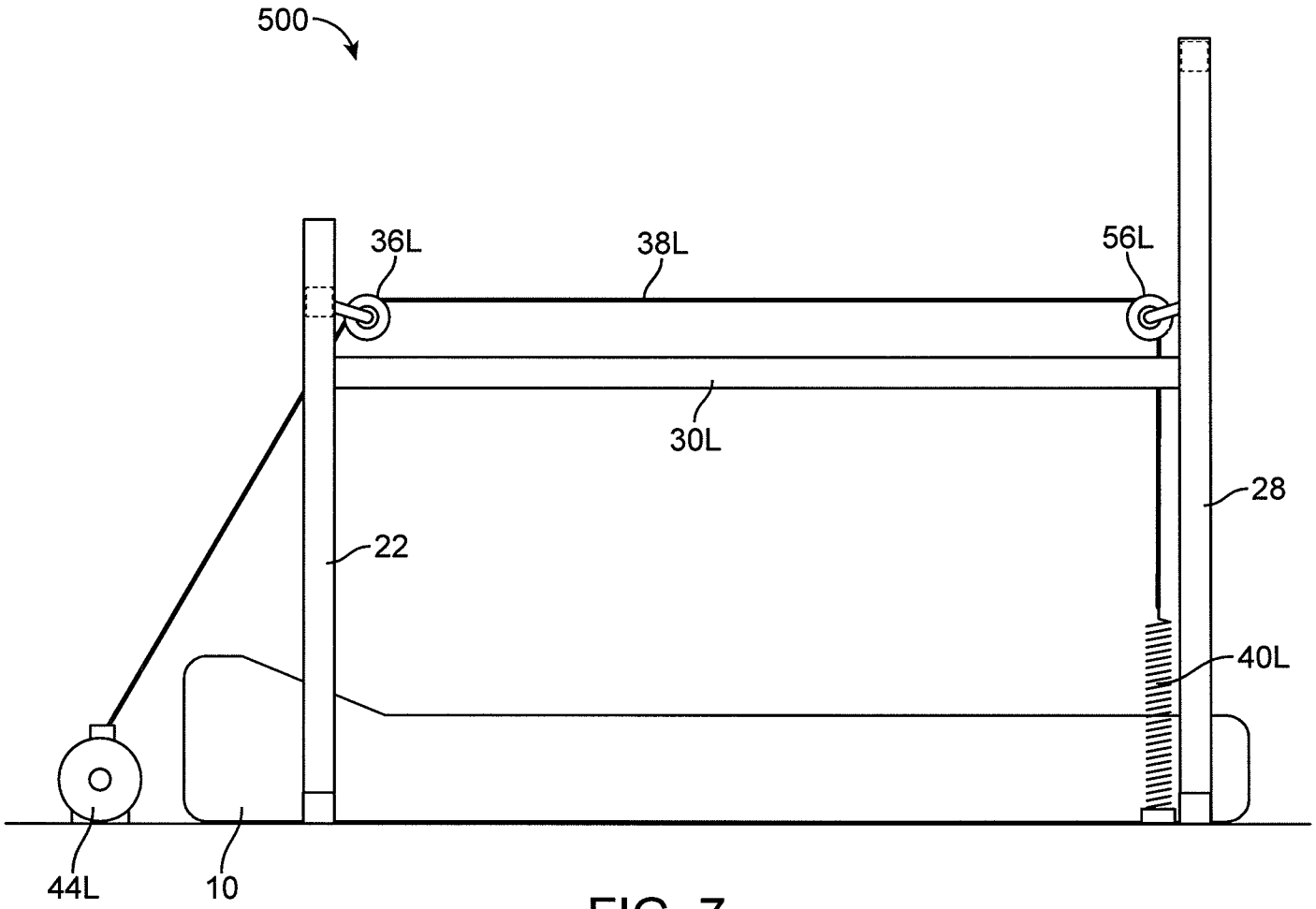
FIG. 7 is a side view of a support frame and a cable based unweighting system of FIG. 4 with a motor driven front cable attachment showing alternative positioning of the front and rear rollers.

FIG. 7 is a side view of another cable unweighting system 500 for use with an exercise device, such as a treadmill 10. The system is similar to system 200 with a winch system connected to the end of the cables. However, unlike embodiments previously described, the rear pulleys 56L,R of system 200 are substantially vertically level with the front pulleys 36L,R.

Figure 8:
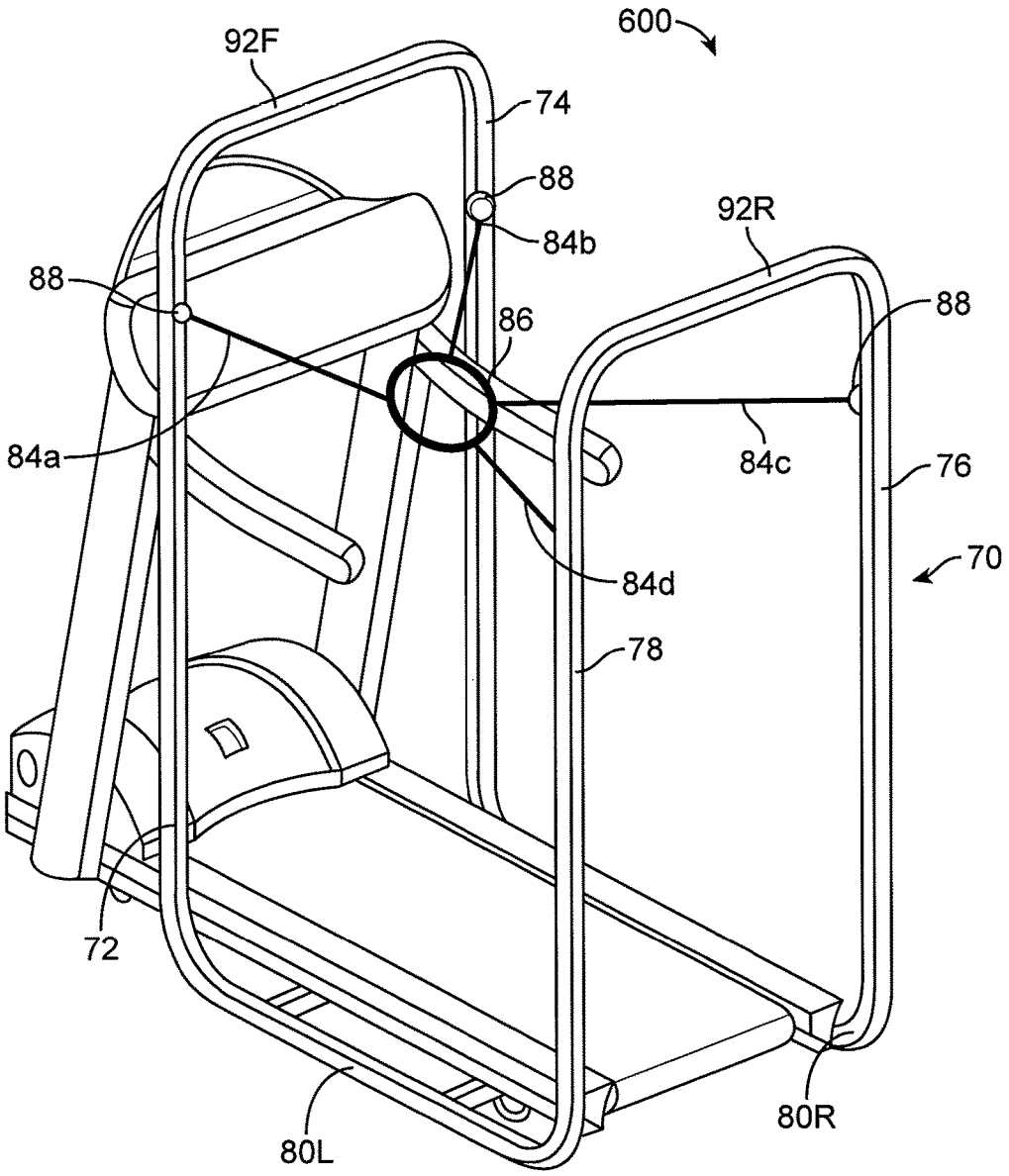
FIG. 8 is a perspective view of an alternative support frame and a cable system.
Figure 15:
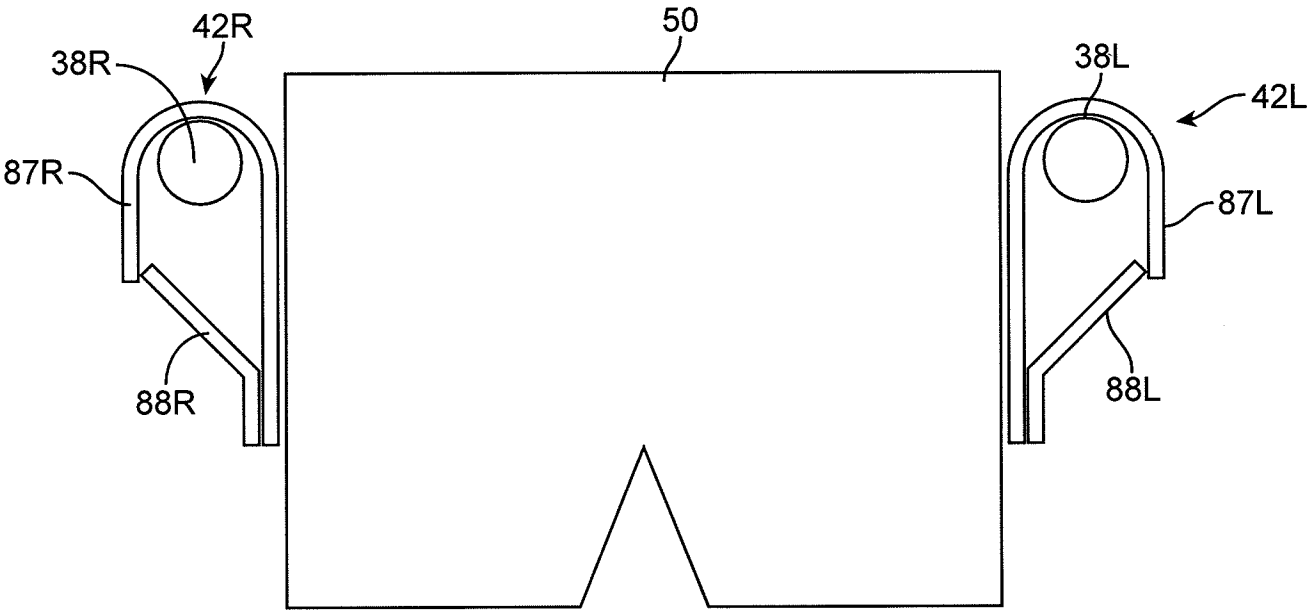
FIG. 15 is a section view of a user and a hook based cable attachment device.

FIG. 8 is a perspective view of another cable unweighting system 600. The unweighting system 600 includes a support frame 70 that includes uprights 72, 74, 76, and 78 joined together by longitudinal supports 80L,R and front and rear cross supports 92F,R. The system also includes a user support 86 configured to receive the user, such as configured to wrap around the user's hips or waist. In some embodiments, the user support 86 is configured as an adjustable frame or shell as described in co-pending U.S. patent application Ser. No. 12/761,316, published as U.S. Patent Application Publication No. 2011/0098615, entitled "Systems, Methods, and Apparatus for Differential Air Pressure Devices," the entirety of which is incorporated by reference herein. For example, the frame or shell 86 may take the form of an adjustable frame, skin or exoskeleton to conform/attach to the user or to an attachment feature worn by the user. Further at least two cables can be used to connect the user support 86 to the support frame 70. For example, four cable segments 84*a*, 84*b*, 84*c* and 84*d* can extend from the user support 86 to the support frame 70. As described in embodiments above, the cables 84 can be connected to the support frame 70 through pulleys 88. Further, the ends of the cables 84 can be connected to the frame 70, to a counterforce member, to a spool driven by a motor, and/or to a winch as described with respect to the embodiments above. More or fewer cables 84 or cable segments may be used or attached to the user support 86 in different configurations. Further, the user support 86 can be replaced with other attachment mechanisms. For example, the system 600 can include a hook or other sliding cable engagement system as illustrated in FIG. 15 or any of the other attachment devices or techniques.

Figure 10:
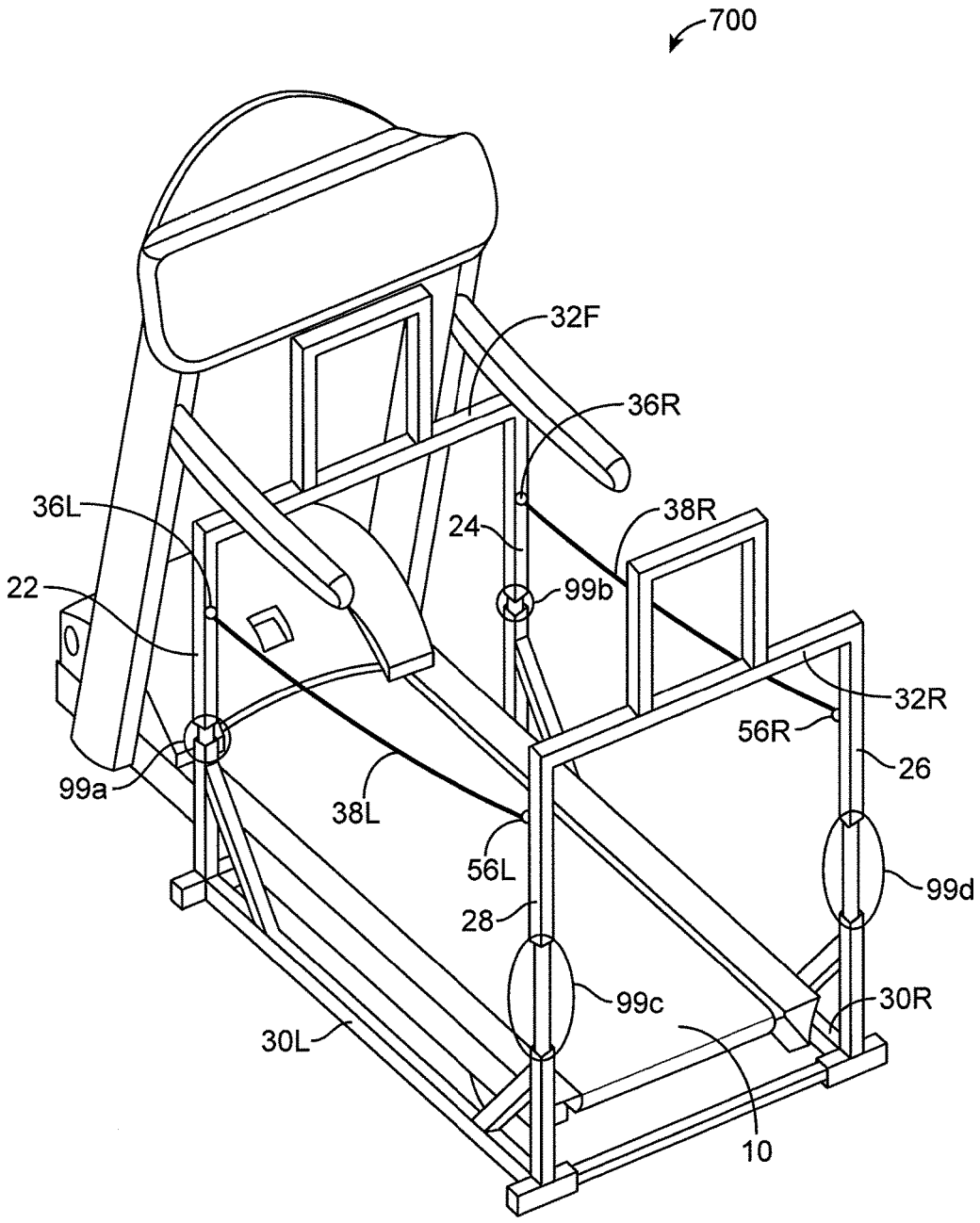
FIG. 10 illustrates a support frame having adjustable height and spacing.

FIG. 10 illustrates another embodiment of a cable unweighting system 700. Similar to system 100, the system 700 can include a support frame having uprights 22, 24, 26, and 28 as well as cables 38L,R extending therebetween from pulleys 36L,R and 56L,R. Similar to other embodiments, the cables 38L,R can end in attachment points on the frame, counterforce members, spools drive by motors, and/or winches. Further, the uprights 22, 24, 26, 28 can be adjustable in height through adjustment sections 99*a,b,c,d*. Height adjustment sections can include, for example, a lead screw and nut, a roller and track, and or any other height adjustment mechanism. Further, in some embodiments, the height adjustment can be motorized. The height adjustment sections 99*a,b,c,d* can advantageously adjust the height of the pulleys 38L,R to better fit the user (i.e., such that the cables 38L,R can sit closer to the user's hips in use), to move the frame out of the way as the user enters or exits the system, to permit closer packing of the system for 100 storage, and/or to adjust the frame for placement about different exercise equipment. Similar suitable adjustment portions may be provided to other portions of the frame, such as the crossbars 32F,R.

Figure 11A:
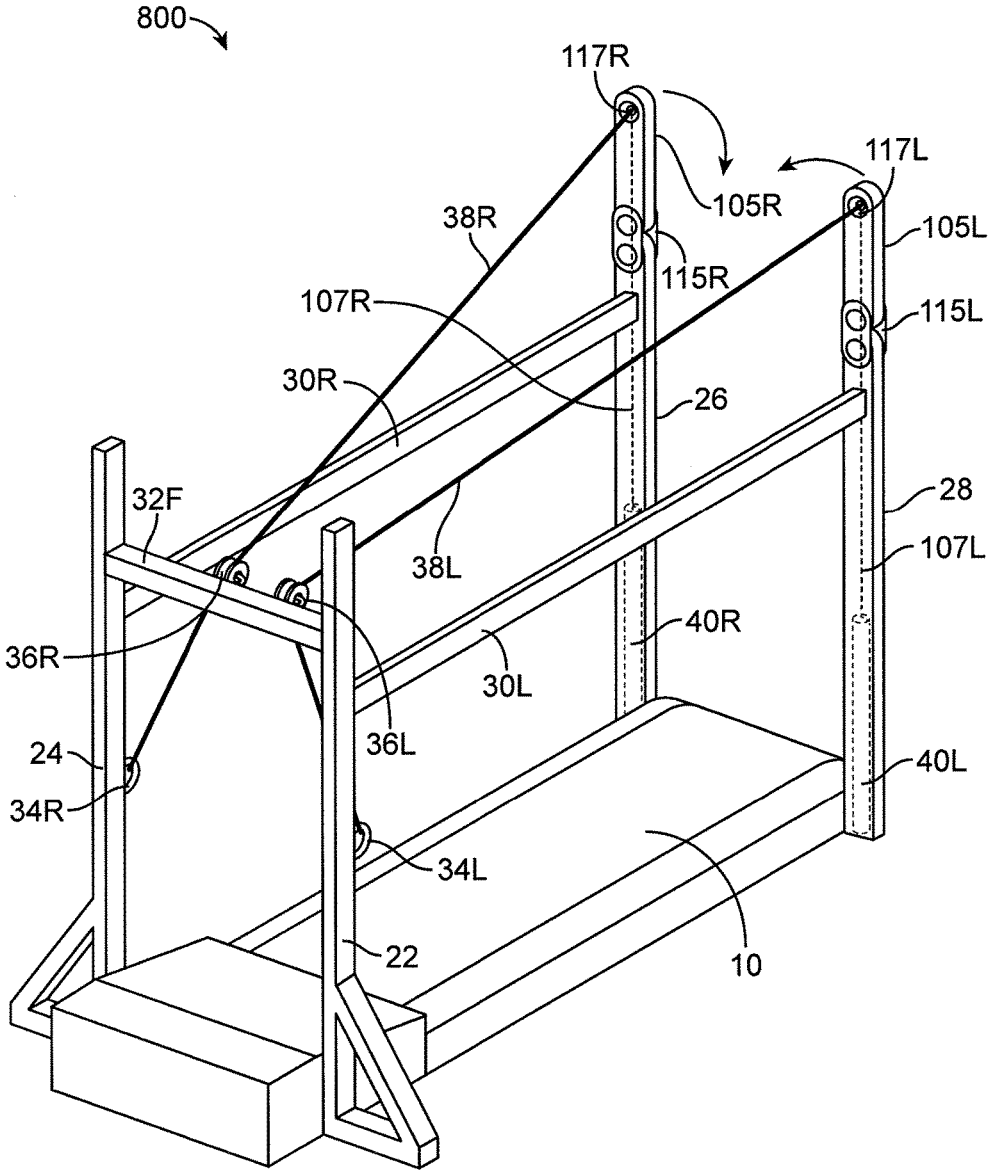
FIGS. 11A and 11B illustrate a support frame having a rotating rear support in open and closed configurations, respectively.
Figure 11B:
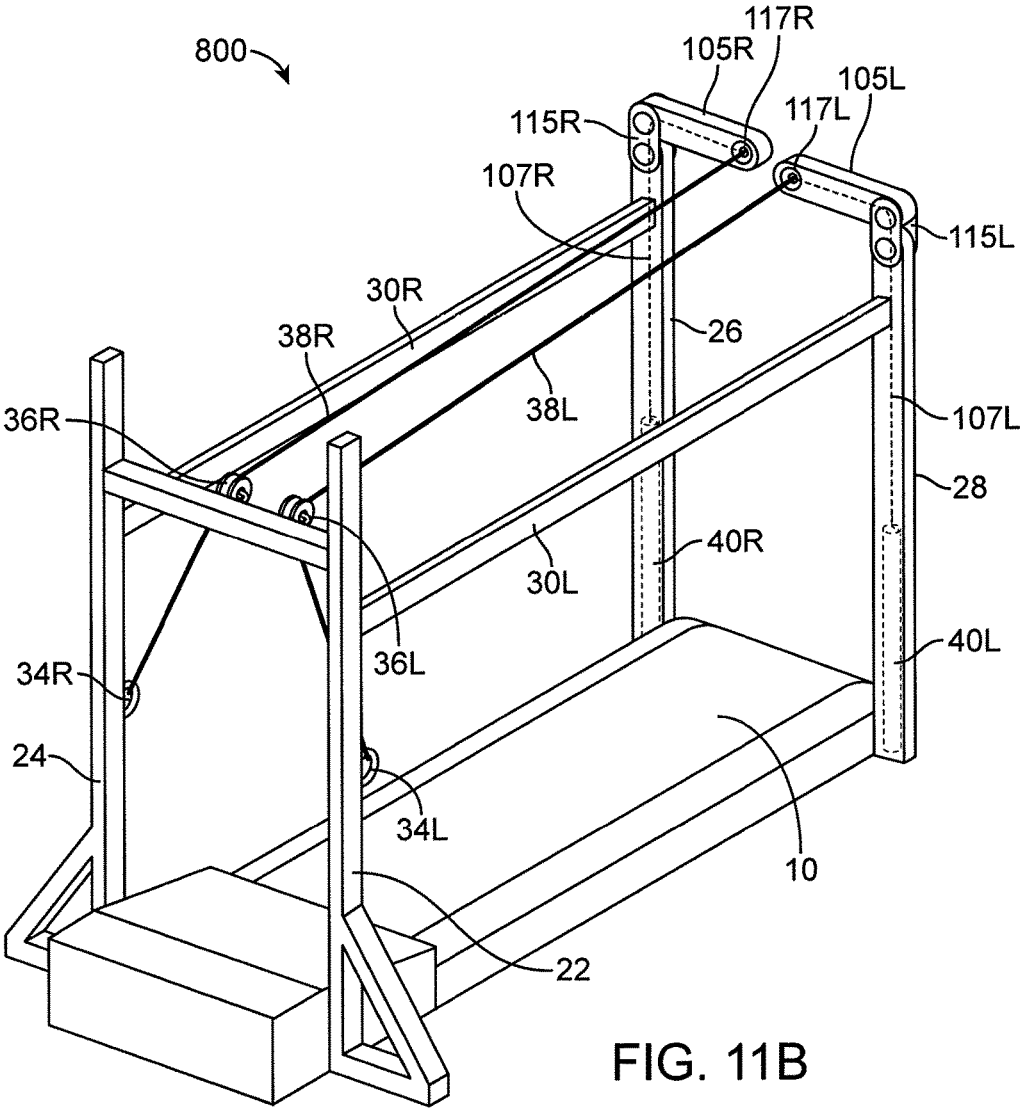

FIGS. 11A-11B show another exemplary cable unweighting system 800. The unweighting system 800 includes similar elements to system 100 except that the rear cross bar is replaced with a pair of pivoting or rotating arms 105L,R and the counterforce members 40L,R are within the uprights 26, 28. The rotating arms 105L,R can extend from rear uprights 26, 28. The cables 38L,R can connect to the arms 105L,R through rear access points 117L,R, which can include a pulley therein. Each of the arms 105L,R can be connected to the rear uprights 26, 28 through a hinge 115L,R, such as a pin connection. The rotating arms 105L,R can thus move from a raised position (shown in FIG. 11A) to a lowered position (shown in FIG. 11B). Further, the cables 38L,R can simultaneously move with the rotating arms 105L,R. The rotating arms 105L,R can be raised to permit easy entry (FIG. 11A), i.e., by moving the arms 105*a,b* out of the way and simultaneously moving the cables 38L,R further from the center line of the treadmill 10. When the rotating arms 105L,R are lowered (FIG. 11B), the cables can be positioned for use adjacent to the user. One or more electrical or mechanical limits or stops may be placed on the rotating arms 105L,R to limit arm travel either upward or down ward.

In some embodiments, the rotating arms 105L,R may be biased into one position and then moved into another during use. For example, the arms 105*a,b* can be biased upward to permit entry into the system and then under load, the arms 105*a,b* can be biased down to a position where the cables 38L,R are moved into a position for use. If biased into the upper position, then under load, the arms 105L,R can swing down into a lower position. In the lower position, the pulley or roller within the access points 117L,R can be in the desired vertical position relative to the user and in the desired lateral or other relative position. Once in a lowered position, the arms 105L,R may raise up with assistance or by spring load into the desired position for the user fit or comfort. In one aspect, the arms 105R,L are biased upward such that there is a clear walk up rearward path to approach the treadmill 10. Initial loading will lower the arms and place the cables 38L,R into a position to ease attachment to the clip or cable attachment component on the user to the cable. Thereafter, further adjustment of the off load system (i.e., a winch or other cable movement device as described herein) will act to lift the user and decrease the amount of load borne by the user.

Figure 11C:
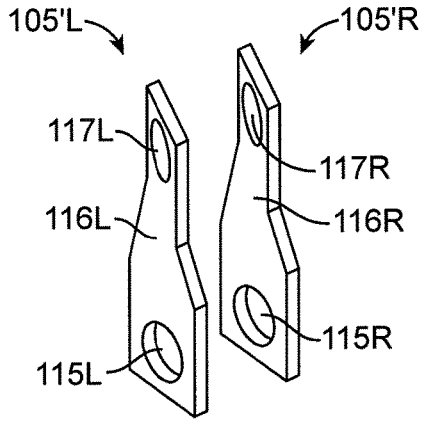
FIG. 11C illustrates a perspective view of a rotating rear support.

FIG. 11C illustrates a perspective view of an alternative rotating arm 105'L,R. The rotating arm 105'L,R includes angular portions and tapers from one end (near the pinned opening 115L,R) to the other end (near access point 117L,R). Further, the rotating arm 105'L,R can include a twist section 116L,R between pinned openings 115L,R and access points 117, which can advantageously help provide the desired torque during use. The degree of twist in section 116L,R determines the relationship between the openings 115L,R and 117L,R, as well as the ultimate relationship of the associated cables 38L,R to the user when the upper arm 105L,R is moved into a lowered position. Twist sections 116L,R may range from 0 (as shown in FIG. 11A) to 5°, 10°, 15°, 20°, 25°, 30°, 35° or more.

Moreover, as noted above, the counterforce members 40L,R of system 800 can be positioned within the uprights 40L,R. Resilient member 40L,R is shown in phantom in the views of FIGS. 11A and 11B. In addition, FIGS. 11A and 11B illustrate the inclusion of a cable run 107L,R within the rear uprights 26, 28 such that the cable 38L,R can extend therethrough after passing through a pulley in the access points 117L,R. Placing the cables 28L,R and the counterforce members 40L,R within the uprights 26, 28 can advantageously keep them out of the way of users, make the design more compact, and help constrain the movement of the ends of the cables 38L,R. It is to be understood that any of the other embodiments described herein can likewise include cable runs and/or counterforce members within the interior portions the support frame.

Figure 12A:
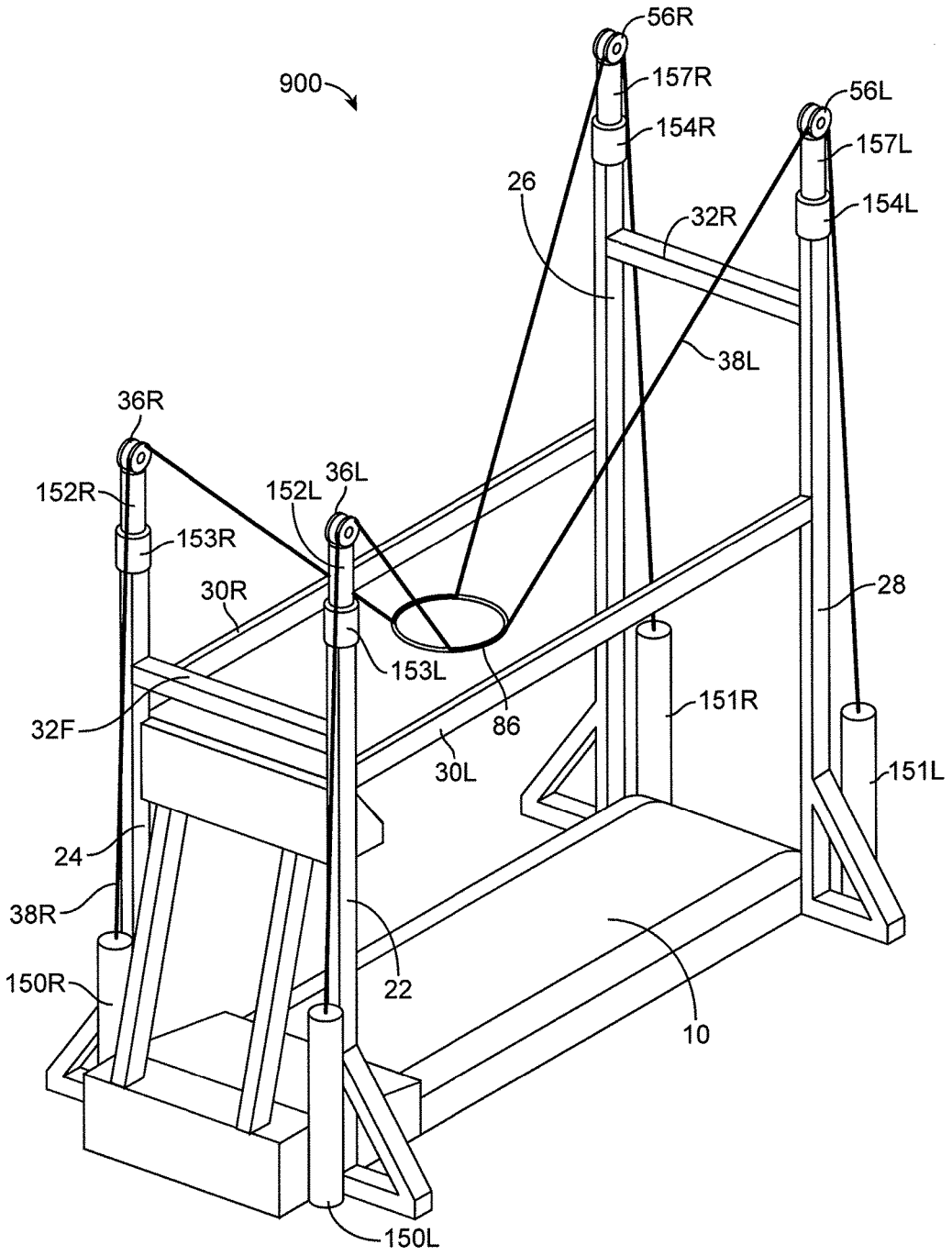
FIGS. 12A and 12B illustrate perspective and side views, respectively, of a cable unweighting system having load cells configured to measure unweighing levels of a user.
Figure 12B:
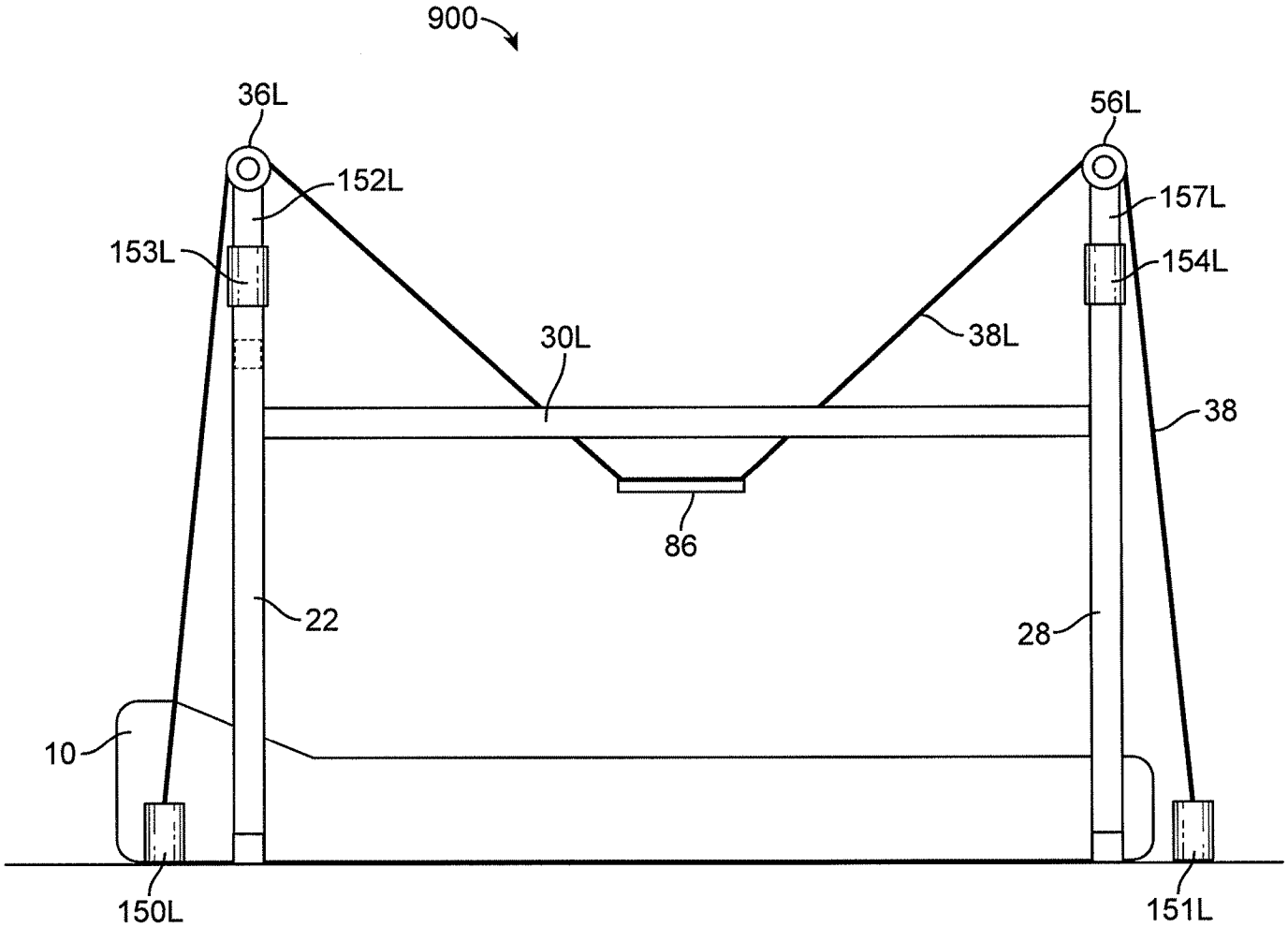

FIGS. 12A and 12B show another embodiment of a cable unweighting system 900. The cable unweighting 900 is similar to the cable unweighting system 100 except that the cables 38L,R each end in a front lower load cell 150R,L and a rear lower load cell 151R,L. The lower load cells 150L,R and 151L,R are positioned near the base of the system 900 where the cables 38L,R terminate. In some embodiments, the lower load cells 150L,R and 151L,R can include a load cell driver, such as a motor driven spool. The load cell driver can be configured to reel in or otherwise control the amount of force placed on the cables 38L,R. The lower load cells 150L,R, 151L,R can be configured to measure the force on the cables 38L,R at the terminal ends. Further, a front or rear upper load cell 153L,R and 154R,L is positioned proximate to each pulley 36L,R and 56L,R. The upper load cells 153L,R and 154L,R are positioned on each upright 22, 24, 26, 28. The position of the upper load cells 153L,R and 154L,R can be adjustable. The pulleys 36L,R and 56L,R may have a load cell piston 152L,R, 157L,R attached between it and the upper load cells 153R,L and 154R,L indicate the forces acting on the pulley 36. That is, the pulleys 36L,R and 56L,R can thus be slideably mounted to the upper load cells 153L,R and 154L,R so that the load cells 153L,R and 154L,R can measure the downward force exerted on the pulleys 36L,R and 46L,R.

As shown in FIGS. 12A and 12B, the cables 38L,R can extend from the front lower load cells 150L,R over front pulleys 36L,R, down the length of the treadmill 10, over rear pulleys 56L,R and down to the rear lower load cells 151L,R. A user attachment 86 (such as a ring, frame, or other attachment mechanism) can allow a user to attach to the cables for unweighting. Further, the load cells 150L,R, 151L,R, 152L,R, and 154L,R can be used to determine the unweighting levels of a user attached to the cables 38L,R.

In use of the system 900, the difference in readings between upper load cells 153L,R and 154L,R and the lower load cells 150L,R and 151L,R may be used to indicate the load on the cables 38L,R, and thus the amount of unweighting experienced by the user. For example, the downward force measured at each upper pulley 36L,R, 56L,R from the upper load cells 153L,R, 154L,R is the sum of the tension on the cables 38L,R pulling downward parallel to the uprights 22, 24, 26, 28 on the outer side of the pulley 36L,R, 56L,R and the downward component of the force coming from the cable 38L,R attached to the user on the inner side of the pulley 36L,R and 56L,R. To find only the force that is being applied to the user, the tension force measured in the cables 38L,R can be subtracted from the overall force measured at the pulley 36L,R, 56L,R. This calculated force contribution from each of the uprights 22, 24, 26, 28 can be added to arrive at the total upward force exerted on the user, which is the unweighting force. These outputs or other load cell information may be used to provide controllable and repeatable unloading without regard to cable geometry.

Figure 16:
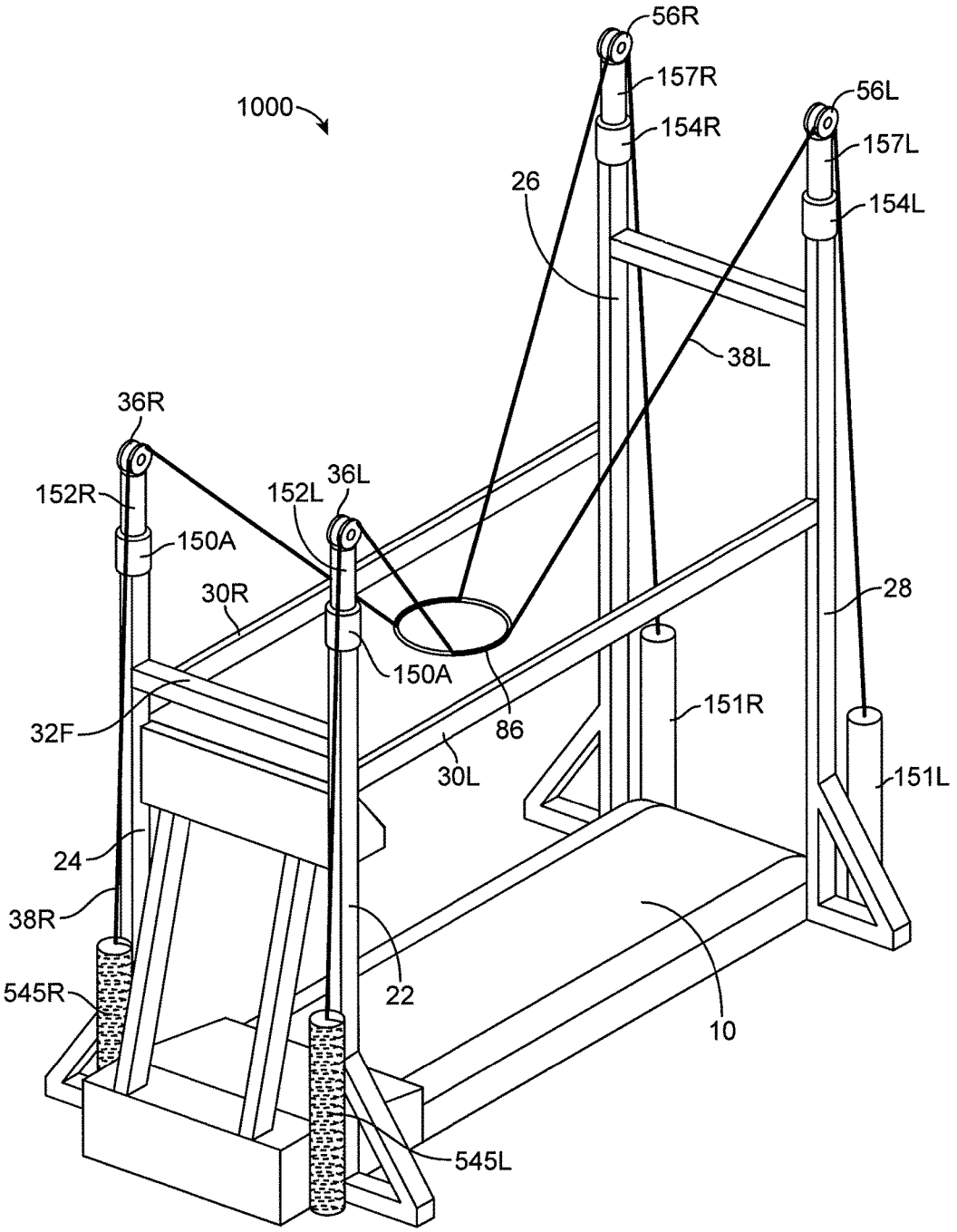
FIG. 16 illustrates a cable unweighting system including load cells and responsive elements connected to the ends of the cables.

Another exemplary cable unweighting system 1000 including load cells is shown in FIGS. 16A-16B. The unweighting system 1000 is similar to system 900, but the front load cells have been replaced with counterforce elements 545R,L, such as coiled springs.

Figure 21:
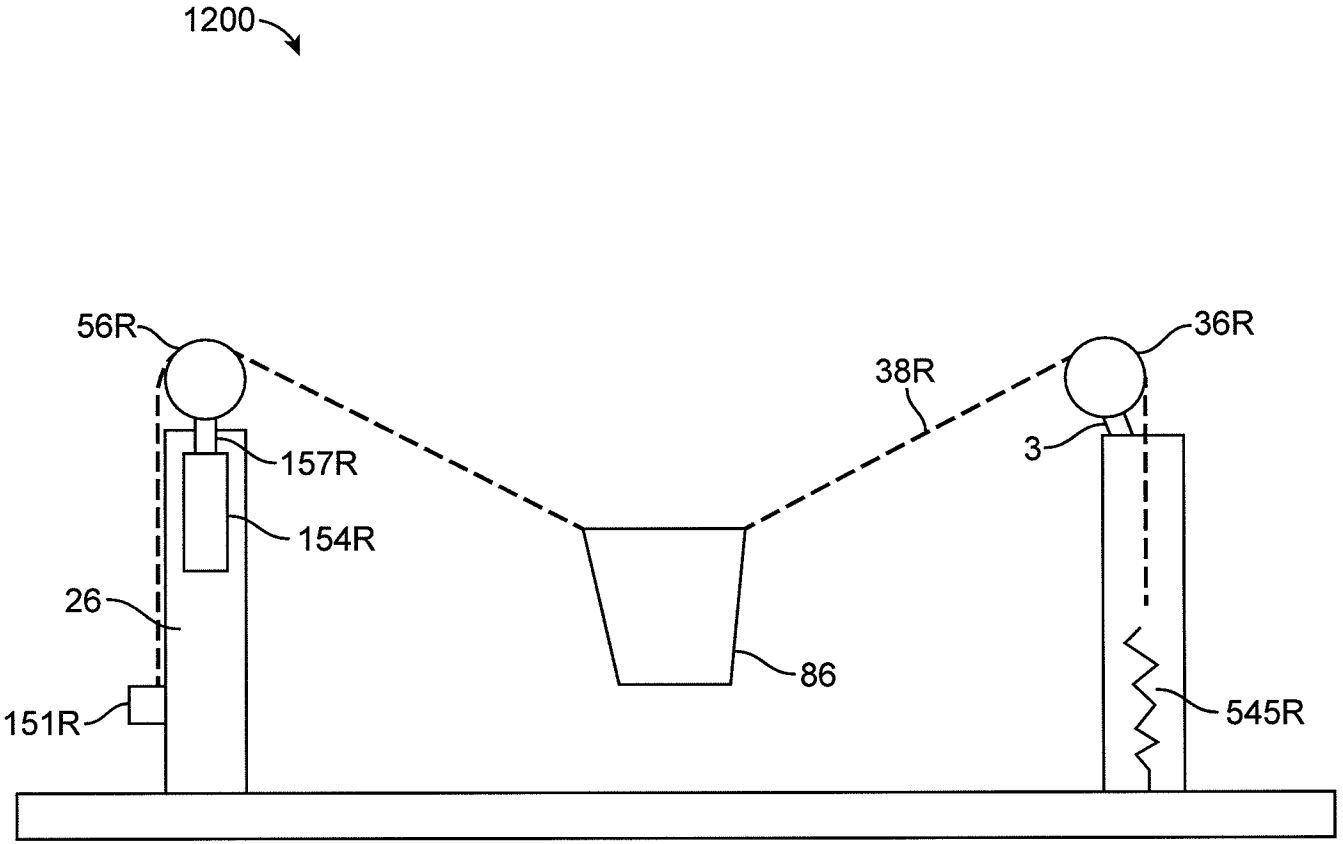
FIG. 21 is a simplified schematic of a side view of a cable unweighting system including load cells and counterforce elements connected to the ends of the cables.

Another exemplary unweighting system 1100 including load cells and counterforce elements is shown in FIG. 21. System 1100 is similar to system 1000 except that the front upper load cells have been removed. Accordingly, system 1000 includes lower load cells 151L,R and two upper load cells 157L,R on the rear uprights 26, 28 with no load cells on the front uprights 22, 24.

In some embodiments, load cells are provided on only two uprights in any of a variety of configurations. One exemplary configuration is to have load cells along both front uprights. Another exemplary configuration is to have load cells along both rear uprights. In still another exemplary configuration, one load cell is provided on one front upright and another load cell is provided on a rear upright. Other simplifications in the use of one or more load cells in the systems described herein are possible based upon the use of the apparent bilateral symmetries as well as the use of cable tension being the same at any point in the cables. Where possible in any of load cell embodiments, the load cells are arranged and constrained by design to measure only vertical forces, in some embodiments. In those instances, it is desirous to have a vertical cable-load cell orientation as nearly as practicable in consideration to other system design parameters. As a result of the size of the exemplary load cells illustrated in FIGS. 12 A, 12B a slight angle is indicated in the cable—load cell connection.

Figure 13:
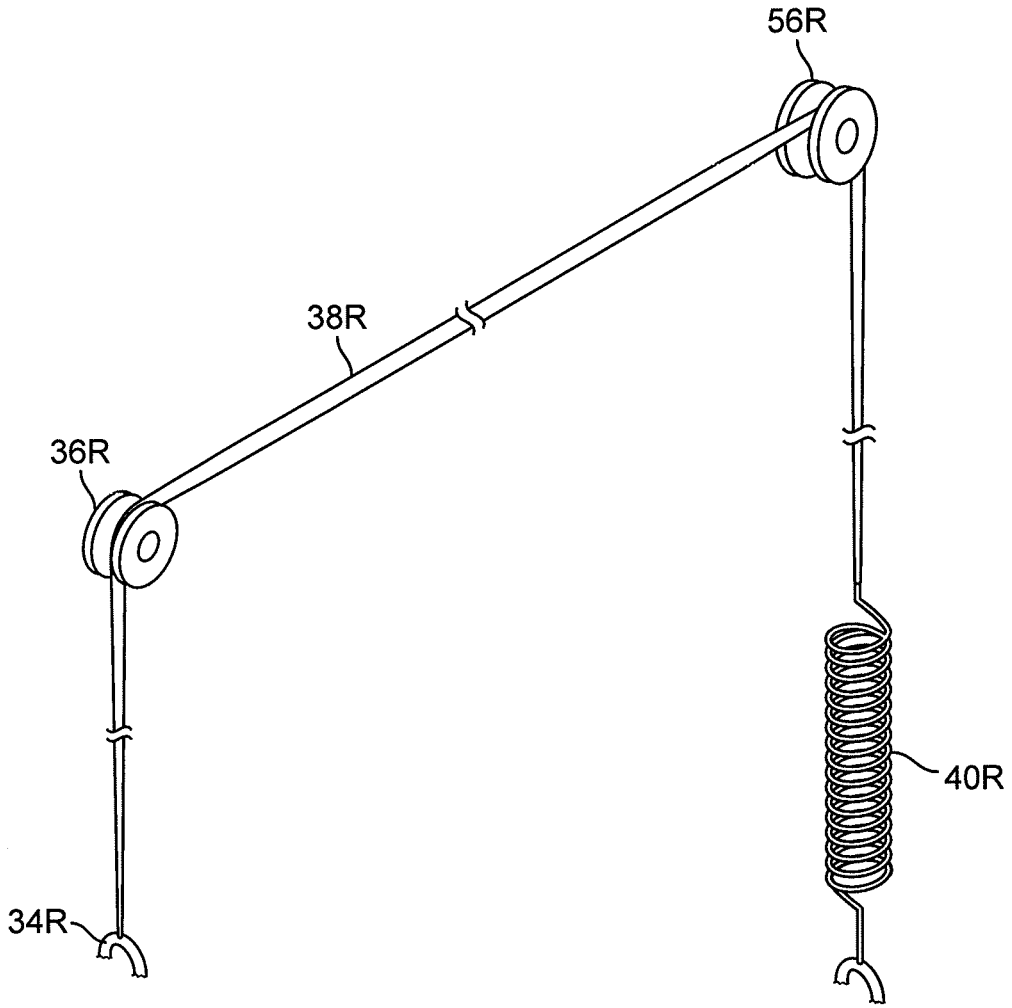
FIG. 13 is a perspective view of a cable having varying diameter.

The cables 38L,R for any of the embodiments described herein can have a constant diameter or can have a variable diameter. For example, the cable 38R shown in FIG. 13 includes a thicker diameter along its length between the pulleys 36R, 56R and a thinner diameter near the ends (such as near attachment point 34R or counterforce member 40R).

Figure 14:
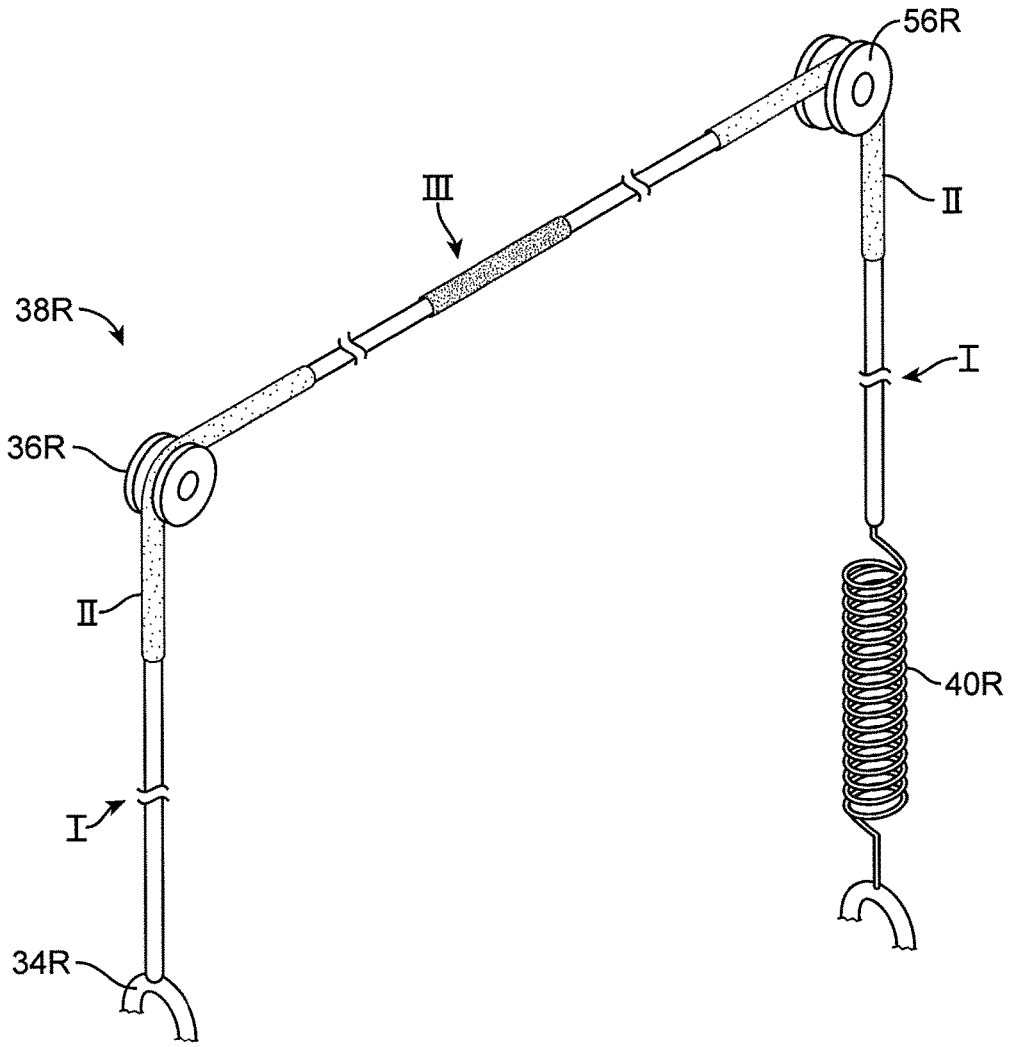
FIG. 14 is a perspective view of a cable having varying composition.

Likewise, the cables 38L,R for any of the embodiments described herein can have the same composition or a varying composition. For example, FIG. 14 shows a cable 38R having various characteristics, such as in sections I, II and III, along its length. The characteristics can be chosen to improve performance of the cable 38R in a cable based unweighting system as described herein. The cable 38R may be bare or covered along all or a portion of the length used, such as in section I. The cable may be covered with a first sleeve and then a second sleeve of increased lubricity in the area of the attachment point to the user in order to reduce the friction between the cable and the attachment mechanism, such as in section III. For example, if a roller is being worn by the user then the area on the cable 38R that interacts with the user borne roller may have additional coating that is better suited to rolling with the roller or other reduced friction coupling. In a similar way, the cable 38R may have a coating to reduce friction between cable 38R and pulleys 36R and 56R as shown in area or section II.

Figure 17:
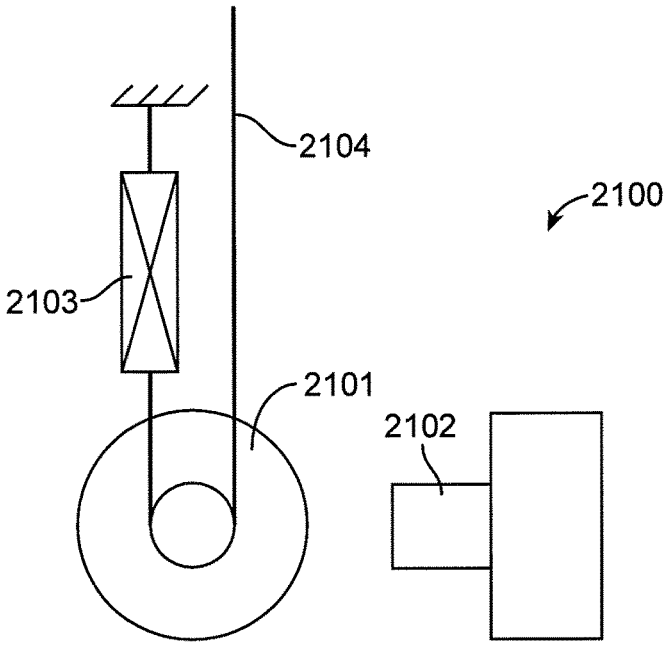
FIG. 17 is a schematic of a rotary based dynamic unweighting device.
Figure 18:
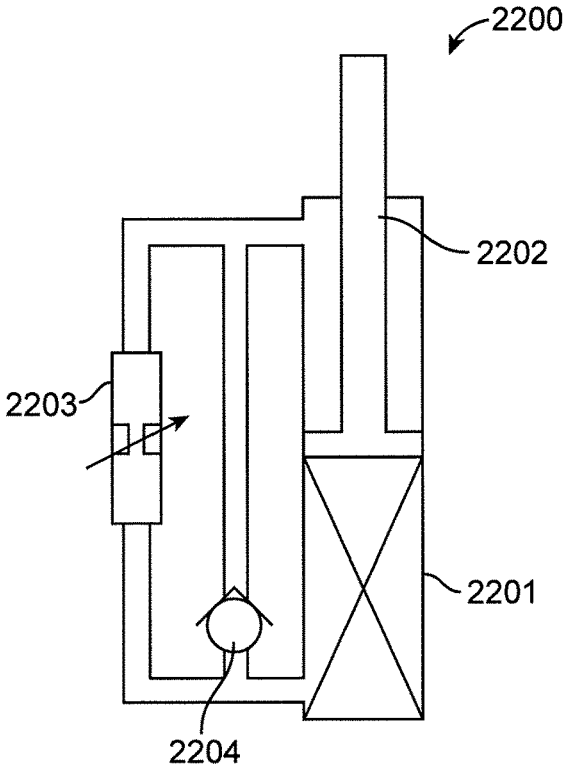
FIG. 18 is a schematic view of a linear based dynamic unweighting device.

Unaided running comfort is due not only to the amount of body weight that is carried by the runner's joints, but also by the amount of impact that the runner experiences with each foot strike. While steady-state unweighting systems lessen joint impact to some extent, existing systems are independent of velocity or acceleration, which are key contributors to impact. Thus, referring to FIGS. 17 and 18, in some embodiments, systems described herein can be designed to provide velocity dependent dynamic unweighting that can be used independently or in conjunction with static, steady-state unweighting systems to further improve the running experience. Dynamic resistance can be controller mechanically or electronically to tune magnitude, phase, and stiffness. FIG. 17 is a schematic of a rotary based dynamic unweighting device 2100 that can be used with a cable system in place of, or in addition to, any of the unweighting mechanisms described herein. The system of claim 21 can include a pulley 2101 and a cable 2104 (configured to be attached to the user as described in embodiments above). A spring 2103 with variable spring resistance can be placed within the cable 2104. Further, a one-way clutch 2101 can be used to provide variable dampening and/or inertia. FIG. 18 is a schematic view of a linear based dynamic unweighting device 2200. The device 2200 includes a pneumatic cylinder 2202, a gas or mechanical unweighting spring 2201, a check valve 2204, and a variable flow resistor 2203. Vertical cable or rod motion can activate the device 2200 to provide variable resistance or inertia. In one aspect, either the rotary or linear devices 2100, 2200 can be used in an unweighting system to provide for asymmetric treatment of unweighting of the user to accommodate for various gait mechanics. One particular example is to employ the system of FIG. 17 or 18 in order to dampen the landing or foot strike of a user. Rather than a constant unweighting response, the systems illustrated in FIGS. 17 and 18 are configured to provide the inertia needed to compensate for impact velocity and acceleration or other gait or biomechanical loading that would benefit from such loading.

Figure 19A:
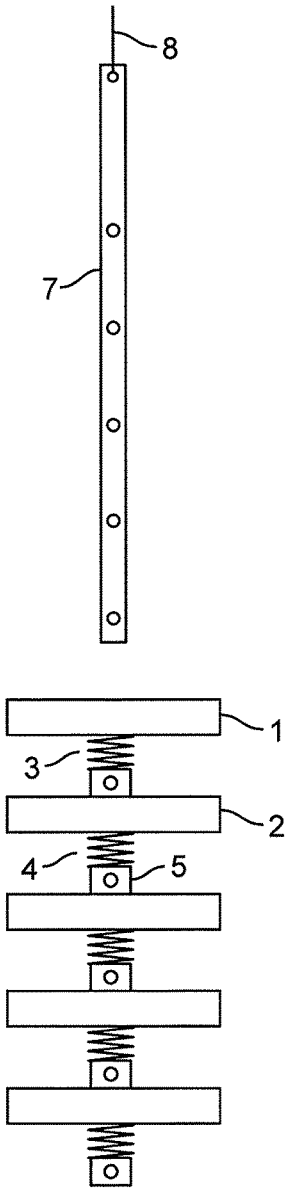
FIGS. 19A, 19B and 19C are various views of a weight stack for use in unweighting a runner having a dampened response.
Figure 19B:
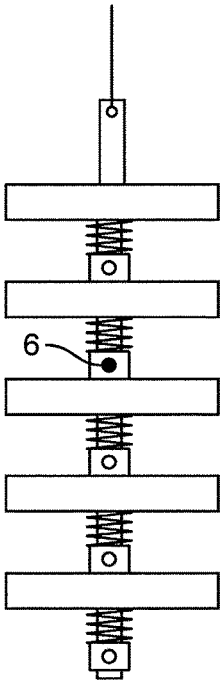
Figure 19C:
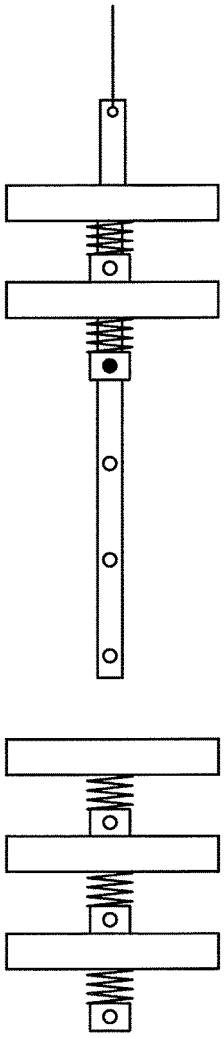

Any of the embodiments described herein can include a weight stack in place of, or in addition to, the unweighting mechanisms described herein. The weight stack can, for example, be placed at the ends of cables 38L,R. FIGS. 19A, 19B and 19C are various views of a weight stack for use in unweighting a user attached to an unweighting cable 8 such that a dampened response occurs. To decouple the weight stack's inertia from the user, compliant members (such as springs 3,4 labeled in FIG. 19A) are introduced between the weight stack and the user. Further, the compliant members have a spring rate K, which is governed by the equation F>SQRT(K/M), where M is the mass being isolated and SQRT(K/M) is the natural frequency of the spring mass system being excited. The configurations illustrated in FIGS. 19A, 19B and 19C are but one possible configuration. As best seen in FIG. 19A, the mass of lifting rod 7 would be minimized as it couples directly to the user. Spring rate K for spring 3 would be chosen based on the equation above and the mass of top weight 1. Spring rate K for spring 4 would be chosen roughly based on the equation above and the masses of both weights 1 and 2. It can also be appreciated that damping can be added to the system as well to further minimize the effects of weight stack inertia. A parallel embodiment can also be envisioned where weight/spring pairs are lifted separately instead of in a stack and where the K/M ratios are the same for each weight/spring pair. For more accurate tuning of the K/M ratios, Finite Element Analysis can also be used to analyze more complex vibration modes beyond the first order modes predicted by the equation above.

In some embodiments, the unweighing force for any of the embodiments described herein may be provided as described in co-pending International Patent Application No. PCT/US2014/028694, filed on Mar. 14, 2014, and titled "Cantilevered Unweighting Systems," the entire contents of which are incorporated by reference herein. In one particular aspect, the use of a weight stack alone or in combination with a tuned response element may be advantageously incorporated into the unweighting system illustrated and described in FIGS. 12A and 12B. In one implementation, a weight stack and specifically selected tuned response element are provided in place of one or more of the lower load cells described herein. In another implementation, a weight stack and specifically selected tuned response element are provided in place of one or more the upper load cells on uprights. Still further, the responsiveness element may be positioned along the cable at any selected location based on system design parameters or, alternatively, attached directly to, adjacent, or integral with the load stack.

It is to be appreciated that the user/support frame/pulley placement and resulting cable-user geometries for the embodiments described herein may be provided in a wide variety of configurations. The systems described herein, may be adapted to provide automatic or user initiated coordination of the pulley points and fixation relative to the user. The systems may also provide relative pulley locations in front and rear or elsewhere in relation to the unweighting system, such as placement of the attachments at high front/low rear, uniform height, low front/high rear. The system may also provide cable spacing wide, narrow, or about as wide as user.

It is to be understood that the use of springs or selectively responsive elements may be incorporated into any embodiment described herein. For example, springs or selectively responsive elements may be incorporated adjacent to or in proximity to the motor 44 in the systems shown and described with regard to FIGS. 4, 5, 6, and 7. In still further alternatives, the spring or resilient member may be selected according to the parameters used for a selectively response element. Still further, the manner of utilizing the cable with the various components may be provided in various other ways. For example, in the system illustrated in FIG. 7, the spring or resilient member 40L,R may be moved to be adjacent to the winch 44L,R or between the winch 40L,R and the user. The cable in then terminated at the support frame or upright as desired (i.e., the rear connection no longer includes a spring or resilient member).

The attachment mechanisms described herein can be any suitable attachment mechanism, such as grooves, slots, or hooks. Further, in some embodiments, the attachment mechanisms can be configured to attach to garments worn by the user. The various types of user garments or shorts as well as the various attachment points, even if not illustrated having exemplary user attachment points or other connectors, may be modified to attach to a user in cooperation with any of the garments or fixation techniques or devices described in co-pending International Patent Application No. PCT/US2014/020934, filed Mar. 5, 2014, and titled "UNWEIGHTING GARMENTS," incorporated herein by reference in its entirety.

FIG. 15 illustrates a hip attachment mechanism 42R,L over a cable 38L,R. The mechanism 42L,R includes a cable hook 87L,R. The hook 87L,R may be worn by user as on a belt or otherwise attached to a garment 50 worn by the user. The hook 87L,R is placed onto the cable 38L,R (or rail if provided) by passing the cable/rail 38L,R past spring catch 88L,R. The hook 87L,R permits the user to slide along the cable 38L,R. The inner surface of hook 87L,R that contacts the cable 38 may be polished, coated or treated to reduce friction with cable 38L,R. Additionally or alternatively, the inner surface of the hook 87L,R may be adapted for use with the cables 38L,R. The attachment mechanism 42R,L is secure yet quickly detachable, allowing the user to enter and exit the system quickly. Suspension interface via hook 87L,R applies upward unweighting force as closely to the user's body as possible in order to not interfere with the running envelope or the runner's gait mechanics. Moreover, the interface mechanics of the hook 87L,R allow attachment points to slide fore and aft along cable 38L,R independently, providing natural hip rotation of the user.

Any of the above embodiments may be providing with a load cell, memory recorder, display, indicator, or suitable software or hardware programming to provide repeatability of system operation from user to user or session to session.

Further, for any of the above described cable systems, the pair of cables can be used to provide a mechanical offload or unweighting of a user. The pair of cables may be used with or without spring or variable offload (such as the counter-force member 40L,R shown in FIG. 1). Further, in any of the embodiments described herein, the cable load positions may vary by adjusting the pulley positions, such as by placing the pulleys on moving load arms.

In any of the embodiments described above, the fixation points, pulley locations, and relative spacing between pulleys may be adjusted closer-further or higher-lower to orient the cables relative to the user and the exercise equipment depending upon the specific circumstances of a user and desired training regime. The positions of one or more pulleys or cable fixation points may be adjusted using a number of different techniques. For example, the pulleys or fixation points may be on a sliding connector or adjustable rack that permits gross and fine adjustments either manually or electronically (i.e., motor driven or servo controlled) by a user. For example, the component may be placed in sliding arrangement within a channel or track, such as on an extension or adjustable member and the like. In one specific embodiment, the component is attached to a base that slides within a track formed in or attached to the support frame, or a support frame member such as an upright 22, 24, 26, 28 or cross members 32F, 32R shown in FIG. 1.

The unweighting systems described herein are envisioned to have a form factor permitting use with, but not limited exclusively to use with, a treadmill that can provide and unweighting capability for users. The amount of unweighting is user selectable and is intended to provide effective body weight reductions of up to 80 lbs., in increments of virtually any amount from 1 lb. 5 lbs., 10 lbs., 20 lbs. or more as desired by the user of configuration settings of the system. In some aspects, the form factor and design considerations are intended for use consistent with that of a commercial gym or exercise studio. In addition, the systems described herein include a form factor permitting use directly with known brands of treadmills, such as Precor, Life Fitness and Star Trac. Other treadmill form factors may also be accommodated. The unweighting systems described herein may also be used with other exercise equipment such as stationary bikes, elliptical systems, stair climbers or other equipment where the user's weight may be supported by one of the unweighting systems or techniques described herein. In addition, the form factors of these other similar exercise equipment form factors can be accommodated as well.

The unweighting systems described herein advantageously address the need for a cost-effective system that can be used for exercise alone or, additionally or alternatively, in conjunction with a separate exercise device where the unweighting system can be purchased separately and optionally attached to the separate exercise device in a user's home or gym.

As for additional details pertinent to the present invention, materials and manufacturing techniques may be employed as within the level of those with skill in the relevant art. The same may hold true with respect to method-based aspects of the invention in terms of additional acts commonly or logically employed. Also, it is contemplated that any optional feature of the inventive variations described may be set forth and claimed independently, or in combination with any one or more of the features described herein. Likewise, reference to a singular item, includes the possibility that there are plural of the same items present. More specifically, as used herein and in the appended claims, the singular forms "a," "and," "said," and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise herein, all technical and scientific terms used herein have the same meaning as commonly understood by one of ordinary skill in the art to which this invention belongs. The breadth of the present invention is not to be limited by the subject specification, but rather only by the plain meaning of the claim terms employed.

The invention claimed is:

1. An unweighting exercise system, comprising:

a frame configured to be attached to or placed at least partially around an exercise device, the frame including a front portion and a rear portion;

a pair of front pulleys coupled to the front portion;

a pair of rear pulleys coupled to the rear portion;

a first cable passing through a first of the pair of front pulleys and through a first of the pair of rear pulleys;

a second cable passing through a second of the pair of front pulleys and through a second of the pair of rear pulleys, the first and second cables configured to couple with a user positioned between the first cable and the second cable and between the pair of the front pulleys and the pair of the rear pulleys to unload a portion of the user's weight as the user exercises on the exercise device;

a first lower load cell connected to an end of the first cable;

a second lower load cell connected to an end of the second cable;

a first upper load cell connected to the first of the pair of front pulleys or the first of the pair of rear pulleys;

a second upper load cell connected to the second of the pair of front pulleys or the second of the pair of rear pulleys; and a controller in communication with the load cells, wherein the controller is configured to obtain data from the load cells to determine an amount of unloading of the user when the user is coupled to the first and second cables, wherein each pulley of the pair of front pulleys is mounted to a load cell piston to indicate force acting on each pulley.

2. The unweighting system of claim 1, further comprising third and fourth lower load cells connected to ends of the first and second cables opposite to the ends connected to the first and second lower load cells.

3. The unweighting system of claim 1, further comprising third and fourth upper load cells such that each of the pulleys includes an upper load cell connected thereto.

4. The unweighting system of claim 1, wherein the controller is configured to determine the amount of unloading of the user by determining a difference in readings between the upper load cells and the lower load cells.

5. The unweighting system of claim 1, wherein each pulley of the pair of rear pulleys is mounted to a load cell piston to indicate force acting on each pulley.

6. The unweighting system of claim 1 wherein while the portion of the user's weight is unloaded, the first cable and the second cable are configured to be coupled at or near the user's waist.

7. The unweighting system of claim 1 wherein a spacing between the pulleys of the pair of front pulleys is wider than a spacing between a location where the first cable is coupled to the user and a location where the second cable is coupled to the user.

8. The unweighting system of claim 1 wherein a spacing between the pulleys of the pair of rear pulleys is wider than a spacing between a location where the first cable is coupled to the user and a location where the second cable is coupled to the user.

9. The unweighting system of claim 1 wherein while the portion of the user's weight is unloaded, the first cable and the second cable are configured to be clipped to the user.

10. The unweighting system of claim 1 wherein while the portion of the user's weight is unloaded, the first cable and the second cable are configured to be hooked to the user.

11. The unweighting system of claim 1 further comprising a user support configured to be worn by the user wherein the first cable and the second cable are configured to be coupled to the user by the user support.

12. The unweighting system of claim 11 wherein the user support is a pair of shorts.

* * * * *